US012653272B2

(12) United States Patent
Bailly et al.

(10) Patent No.: US 12,653,272 B2
(45) Date of Patent: Jun. 16, 2026

(54) BLADDER SYSTEMS WITH CLOSABLE FLUID LINE AND FOOT SUPPORTS INCLUDING SUCH BLADDER SYSTEMS

(71) Applicant: NIKE, Inc., Beaverton, OR (US)

(72) Inventors: Devin Bailly, Portland, OR (US); Levi J. Patton, Portland, OR (US); Eric A. Schmalzer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/961,205

(22) Filed: Nov. 26, 2024

(65) Prior Publication Data

US 2025/0176668 A1 Jun. 5, 2025

Related U.S. Application Data

(60) Provisional application No. 63/604,566, filed on Nov. 30, 2023.

(51) Int. Cl.

| | |
|---|---|
| ***A43B 13/20*** | (2006.01) |
| ***A43B 7/142*** | (2022.01) |
| ***A43B 7/143*** | (2022.01) |
| ***A43B 7/144*** | (2022.01) |

(52) U.S. Cl.

CPC ..... *A43B 13/206* (2013.01); *A43B 7/142* (2013.01); *A43B 7/143* (2013.01); *A43B 7/144* (2013.01); *A43B 13/203* (2013.01)

(58) Field of Classification Search

CPC ..... A43B 13/20; A43B 13/203; A43B 13/206
See application file for complete search history.

(56) References Cited

U.S. PATENT DOCUMENTS

| | | | | |
|---|---|---|---|---|
| 4,312,140 | A | 1/1982 | Reber | |
| 4,589,626 | A * | 5/1986 | Kurtz | A61M 39/288 251/10 |
| 5,706,589 | A * | 1/1998 | Marc | A43B 13/182 36/27 |

(Continued)

FOREIGN PATENT DOCUMENTS

WO 20240145326 A1 7/2024

OTHER PUBLICATIONS

Mar. 20, 2025 (WO) International Search Report and Written Opinion—App PCT/US2024/057647, 12 pages.

*Primary Examiner* — Ted Kavanaugh
(74) *Attorney, Agent, or Firm* — Banner & Witcoff, Ltd.

(57) ABSTRACT

Bladder systems include a fluid line formed between layers of thermoplastic elastomer. The fluid line may include: (i) a first fluid line region extending in a direction away from a main interior bladder chamber, (ii) a second fluid line region extending from the first fluid line region and in the direction away from the main interior bladder chamber, and (iii) a third fluid line region extending from the second fluid line region. The first and third fluid line regions have a larger transverse cross sectional area than that of the second fluid line region. The fluid line may connect a foot support bladder portion and a fluid reservoir portion in a sole structure/article of footwear. Also, the fluid line may be formed within a flap that extends outward from the main interior bladder chamber (e.g., one of the foot support bladder portion or the fluid reservoir portion).

20 Claims, 8 Drawing Sheets

(56) References Cited

U.S. PATENT DOCUMENTS

| | | | | |
|---|---|---|---|---|
| 6,014,823 | A * | 1/2000 | Lakic | A43B 17/035 36/71 |
| 11,206,896 | B2 * | 12/2021 | Henrichot | A43B 3/38 |
| 11,234,485 | B2 | 2/2022 | Henrichot et al. | |
| 11,653,712 | B2 * | 5/2023 | Costa | A43B 13/203 36/93 |
| 11,969,053 | B2 | 4/2024 | Henrichot et al. | |
| 11,986,053 | B2 | 5/2024 | Henrichot et al. | |
| 2013/0212909 | A1 * | 8/2013 | Bates | A43B 13/203 36/102 |
| 2020/0046071 | A1 | 2/2020 | Henrichot et al. | |
| 2024/0260713 | A1 | 8/2024 | Henrichot et al. | |

* cited by examiner

BLADDER SYSTEMS WITH CLOSABLE FLUID LINE AND FOOT SUPPORTS INCLUDING SUCH BLADDER SYSTEMS

RELATED APPLICATION DATA

This application is a U.S. Non-Provisional application and claims priority to U.S. Provisional Patent Appln. No. 63/604,566 filed Nov. 30, 2023 and entitled "Bladder Systems with Closable Fluid Line and Foot Supports Including Such Bladder Systems." U.S. Provisional Patent Appln. No. 63/604,566 is entirely incorporated herein by reference.

FIELD OF THE INVENTION

The present technology relates to bladder systems, foot support systems, sole structures, articles of footwear, and/or other foot-receiving devices. Some more specific aspects of the present technology pertain to bladder systems, foot support systems, sole structures, articles of footwear, and/or other foot-receiving devices that include a fluid line that is openable and closable, e.g., by a switch, clamp, or other device. Additional aspects of this technology relate to methods of making and/or using such bladder systems, foot support systems, sole structures, articles of footwear, and/or other foot-receiving devices.

Aspects of this technology may be used in conjunction with footwear components and footwear structures of the types described and illustrated in U.S. Provisional Patent Appln. No. 63/604,559 and entitled "Sole Structures and Articles of Footwear Including Bladder Systems with Closable Fluid Line," which application is entirely incorporated herein by reference.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to moderate pressure applied to the foot by the laces). The upper also may include a heel counter to limit or control movement of the heel.

SUMMARY OF THE INVENTION

This Summary is provided to introduce some general concepts relating to this technology in a simplified form that are further described below in the Detailed Description. This Summary is not intended to identify key features or essential features of the claimed invention.

Aspects of this technology relate to bladder systems, foot support systems, sole structures, articles of footwear, and/or other foot-receiving devices, e.g., of the types described and/or claimed below and/or of the types illustrated in the appended drawings. Such bladder systems, foot support systems, sole structures, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Bladder systems, foot support systems, sole structures, articles of footwear, and/or other foot-receiving devices in accordance with at least some aspects of this technology include a fluid line formed of and/or between layers of thermoplastic elastomer (e.g., thermoplastic polyurethanes or "TPUs"). The fluid line may include: (i) a first fluid line region having a first transverse cross sectional area extending in a direction away from a main interior bladder chamber, (ii) a second fluid line region extending from the first fluid line region and in the direction away from the main interior bladder chamber, the second fluid line region having a second transverse cross sectional area that is smaller than the first transverse cross sectional area, and (iii) a third fluid line region extending from the second fluid line region and having a third transverse cross sectional area that is greater than the second transverse cross sectional area.

In some examples, the fluid line may connect a foot support bladder portion and a fluid reservoir portion of a bladder system in a sole structure and/or article of footwear.

Additionally or alternatively, the fluid line may be formed within a flap that extends outward from the main interior bladder chamber (e.g., outward from one of the foot support bladder portion or the fluid reservoir portion). The flap may be exposed, e.g., at the exterior of a sole structure and/or article of footwear. The flap may form a region of the bladder system at which a user can selectively interact (e.g., via a switch or other pinching/clamping component) to open and close the fluid line (e.g., a "pre-bend" or "pre-crease" region).

While aspects of this technology are described in terms of bladder systems, additional aspects of this technology relate to sole structures; articles of footwear; other foot-receiving devices; methods of making such bladder systems, foot support systems, sole structures, articles of footwear, and/or other foot-receiving devices; and/or methods of using such bladder systems, foot support systems, sole structures, articles of footwear, and other foot-receiving devices, e.g., to change foot support bladder pressure in an article of footwear, sole structure, or other foot-receiving device.

BRIEF DESCRIPTION OF THE DRAWINGS

The foregoing Summary of the Invention, as well as the following Detailed Description of the Invention, will be better understood when considered in conjunction with the accompanying drawings in which like reference numerals refer to the same or similar elements in all of the various views in which that reference number appears.

DETAILED DESCRIPTION OF THE INVENTION

Figure 1:
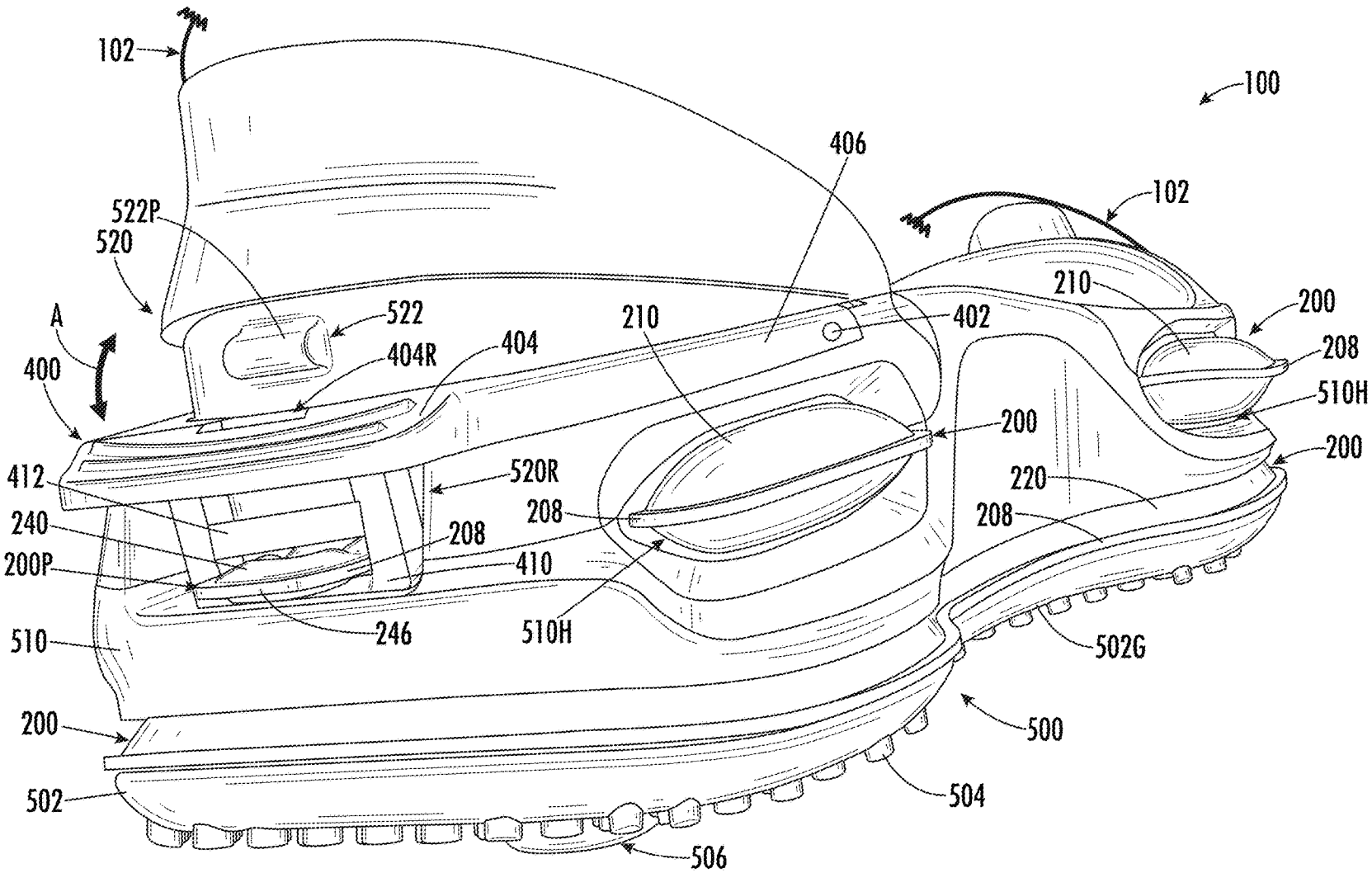
FIG. 1 includes a rear, lateral perspective view of an article of footwear and sole structure in accordance with some examples of this technology.

In the following description of various examples of footwear structures and components according to the present technology, reference is made to the accompanying drawings, which form a part hereof, and in which are shown by way of illustration various example structures and environments in which aspects of the present technology may be practiced. It is to be understood that other structures and environments may be utilized and that structural and functional modifications may be made to the specifically described structures and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion (s) of a plantar surface of a user's foot. "Foot-supporting members" may include components for and/or functioning as midsoles and/or outsoles for articles of footwear (or components providing corresponding functions in non-footwear type foot-receiving devices).

The term "rearward" as used herein means at or toward the heel region of the article of footwear (or component thereof) or other component, and the term "forward" as used herein means at or toward a forefoot or forward toe region of the article of footwear (or component thereof) or other component. Unless otherwise defined: (a) the terms "heel" or "heel region" refer to a back (or rearward) one-third of a sole structure, article of footwear, or other foot-receiving device; (b) the terms "midfoot" or "arch" refer to a central one-third of a sole structure, article of footwear, or other foot-receiving device; and (c) the terms "forefoot" or "forefoot region" refer to a front (or forward) one-third of a sole structure, article of footwear, or other foot-receiving device. Also, the term "lateral" means the "little toe" side or outside edge of an article of footwear or component thereof (e.g., an upper, a sole structure, etc.) or other component, and the term "medial" means the "big toe" side or inside edge of an article of footwear or component thereof (e.g., an upper, a sole structure, etc.) or other component.

The term "port," as used herein includes any opening in a component through which fluid (e.g., a gas) may pass to enter or leave that component. Some "ports" may include one or more hardware components or other structures, e.g., to which a fluid line may connect. In some examples of this technology, a fluid line may connect to a "port" of another component by an adhesive, by a hot melt or welded connection (also called "fusing techniques" herein), by a mechanical connector, or the like. In example structures in which a fluid line is integrally formed with another part (such as a pump, a foot support bladder (e.g., a foot support bladder portion), a reservoir component (e.g., a fluid reservoir bladder portion), or other fluid source component), the "port" may be considered the location where the interior chamber changes in size (e.g., changes in transverse cross-sectional area) from a relatively small fluid channel size to a relatively large and more open volume. "Inlets" and "outlets" as those terms are used herein may be considered "ports."

The term "flap" as used herein means a relatively thin portion of a bladder system that defines a fluid line through it, and the "flap" projects outward from a surface of another, larger portion of the bladder system. The fluid line in the "flap" may be open into and in direct fluid communication with an interior chamber of a larger portion of the bladder system from which it extends. A "flap" may contain (and define) a small portion of a fluid line connecting two larger portions of the bladder system. A "flap" may extend to a free edge, and that free edge may be exposed at the exterior of a sole structure and/or an article of footwear. The portion(s) of a "flap" that define the interior channel of a fluid line extending through the flap may constitute portions of a seam (e.g., a weld line or other seam) joining two layers of thermoplastic elastomer material to form the bladder system and fluid line. Thus, the "flap" may comprise an integral portion of the bladder system structure.

In at least some examples of this technology, the fluid line portion defined within a "flap" will have: (i) one half (e.g., an upper half of the fluid line) defined by a first material layer or sheet forming one half of the flap (e.g., an upper half of the flap) and (ii) another half (e.g., a lower half of the fluid line) defined by a second material layer or sheet forming another half of the flap (e.g., a lower half of the flap). Additionally or alternatively, in some examples, a "flap" will be formed by two interfacing surfaces of material (e.g., facing layers or sheets of thermoplastic elastomer material) and the fluid flow direction through the fluid line portion within the flap will extend generally parallel to the two interfacing surfaces. Still additionally or alternatively, a longitudinal length of the fluid line portion within a "flap" may extend generally parallel to interfacing surfaces of material forming the "flap."

This application and/or its claims use the terms, e.g., "first," "second," "third," and the like, to identify certain components and/or features relating to this technology. These terms are used merely for convenience, e.g., to assist in maintaining a distinction between components and/or features of a specific structure. Use of these terms should not be construed as requiring a specific order or arrangement of the components and/or features being discussed. Also, use of these specific terms in the specification for a specific structure does not require that the same term be used in the claims to refer to the same part (e.g., a component or feature referred to as the "third" in the specification may correspond to any numerical adjective used for that component or feature in the claims).

I. GENERAL DESCRIPTION OF ASPECTS OF THIS TECHNOLOGY

As noted above, aspects of this technology relate to bladder systems, foot support systems, sole structures, articles of footwear, and/or other foot-receiving devices, e.g., of the types described and/or claimed below and/or of the types illustrated in the appended drawings. Such bladder systems, foot support systems, sole structures, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

As some more specific examples, aspects of this technology relate to bladder systems for containing a fluid, e.g., for use in sole structures and/or articles of footwear. Such bladder systems may include: (a) a foot support bladder portion; (b) a fluid reservoir portion; (c) a first fluid line for moving fluid from the fluid reservoir portion to the foot support bladder portion; and (d) a second fluid line for moving fluid from the foot support bladder portion to the fluid reservoir portion. In some examples of this aspect of the present technology, a first portion of the second fluid line extends outward from a heel portion or a midfoot portion of the foot support bladder portion (e.g., rearward from a rear heel portion, sideways, etc.) and may be contained within or defined within a flap (e.g., an exposed flap of the thermoplastic elastomer material forming the bladder(s)). The flap may form an area or a portion of the second fluid line to be selectively "pinched" closed to prevent fluid from moving through the second fluid line (e.g., to change foot support pressure in the bladder system).

Other aspects of this technology relate to bladder systems, e.g., for use in sole structures and/or articles of footwear, that include a first thermoplastic elastomer layer joined to a second thermoplastic elastomer layer at one or more seams to form an interior fluid chamber. This interior fluid chamber may comprise: (a) a foot support bladder portion; (b) a fluid reservoir portion; (c) a first fluid line extending between the fluid reservoir portion and the foot support bladder portion; and (d) a second fluid line extending between the foot support bladder portion and the fluid reservoir portion. In some examples of this aspect of the present technology, a first portion of the second fluid line extends outward from a heel portion or a midfoot portion of the foot support bladder portion (e.g., rearward from a rear heel portion, sideways, etc.) and may be contained within or defined within a flap (e.g., an exposed flap of the thermoplastic elastomer material forming the bladder(s)). This flap may form an area or a portion of the second fluid line to be selectively "pinched" closed to prevent fluid from moving through the second fluid line (e.g., to change foot support pressure in the bladder system).

Other aspects of this technology relate to bladder systems, e.g., for use in sole structures and/or articles of footwear, that include: (a) a first thermoplastic elastomer layer and a second thermoplastic elastomer layer joined together by a first seam portion and a second seam portion, wherein a first interior bladder chamber is defined between the first thermoplastic elastomer layer and the second thermoplastic elastomer layer; and (b) a first fluid line formed between the first thermoplastic elastomer layer and the second thermoplastic elastomer layer, the first fluid line having a first end that opens into the first interior bladder chamber and extending between the first seam portion and the second seam portion. This first fluid line may include: (i) a first fluid line region having a first transverse cross sectional area and extending in a direction away from the first interior bladder chamber, (ii) a second fluid line region extending from the first fluid line region and in the direction away from the first interior bladder chamber, the second fluid line region having a second transverse cross sectional area that is smaller than the first transverse cross sectional area, and (iii) a third fluid line region extending from the second fluid line region and having a third transverse cross sectional area that is greater than the second transverse cross sectional area. At least one of the first fluid line region, the second fluid line region, and/or the third fluid line region may form an area at which the first fluid line can be selectively opened and closed (e.g., a pre-bend or pre-crease area). At least the first fluid line region, the second fluid line region, and the third fluid line region may be included in a flap.

Still other aspects of this technology relate to bladder systems, e.g., for use in sole structures and/or articles of footwear, that include: (a) a first thermoplastic elastomer layer and a second thermoplastic elastomer layer joined together to define a first interior bladder chamber; and (b) a first fluid line having a first end in fluid communication with the first interior bladder chamber. This first fluid line may include: (i) a first fluid line region having a first transverse cross sectional area and extending in a direction away from the first interior bladder chamber, (ii) a second fluid line region extending from the first fluid line region and in the direction away from the first interior bladder chamber, the second fluid line region having a second transverse cross sectional area that is smaller than the first transverse cross sectional area, and (iii) a third fluid line region extending from the second fluid line region and in the direction away from the first interior bladder chamber, the third fluid line region having a third transverse cross sectional area that is greater than the second transverse cross sectional area. At least one of the first fluid line region, the second fluid line region, and/or the third fluid line region may form an area at which the first fluid line can be selectively opened and closed (e.g., a pre-bend or pre-crease area). At least the first fluid line region, the second fluid line region, and the third fluid line region may be included in a flap.

Other aspects of this technology relate to foot support systems, sole structures, articles of footwear, and/or other foot-receiving devices that include bladder systems of the types described above and methods of making and/or using such products.

At least some aspects of this technology may include structures and/or may be used in systems of the types described in: (a) U.S. Pat. No. 11,206,896 B2, (b) U.S. Pat. No. 11,234,485 B2, (c) U.S. Provisional Patent Appln. No. 63/477,719 filed Dec. 29, 2022, (d) U.S. Provisional Patent Appln. No. 63/498,593 filed Apr. 27, 2023, and (e) U.S. Provisional Patent Appln. No. 63/541,431 filed Sep. 29, 2023, each of which is entirely incorporated herein by reference.

Given the general description of features, aspects, structures, processes, and arrangements according to certain examples of this technology provided above, a more detailed description of specific example bladder systems, foot support systems, sole structures, articles of footwear, and methods in accordance with this technology follows.

II. DETAILED DESCRIPTION OF EXAMPLE BLADDER SYSTEMS, FOOT SUPPORT SYSTEMS, SOLE STRUCTURES, ARTICLES OF FOOTWEAR, AND OTHER COMPONENTS/FEATURES ACCORDING TO THIS TECHNOLOGY

Referring to the figures and following discussion, various examples of bladder systems, foot support systems, sole structures, and/or articles of footwear in accordance with aspects of this technology are described.

Example bladder systems 200, foot support systems (e.g., sole structures 500), articles of footwear 100 (or other foot-receiving devices), and/or components thereof in accordance with aspects of this technology now will be described in conjunction with FIGS. 1-3B. FIG. 1 provides a rear, lateral perspective view of a sole structure 500 and article of footwear 100 in accordance with at least some examples of this technology.

The article of footwear 100 shown in FIG. 1 includes an upper 102 and a sole structure 500 engaged with the upper 102. Only a portion of the upper 102 is shown in FIG. 1, but the upper 102 may include any desired materials (e.g. fabrics, leathers, plastics, etc.), components, number of components, constructions, structures, etc., without departing from this technology, including conventional materials, components, numbers of components, constructions, structures, etc., as are known and used in the footwear art. The upper 102 may be engaged with the sole structure 500 in any desired manner, including through the use of one or more of adhesives, stitching, or mechanical fasteners, including in manners conventionally known and used in the footwear arts.

The sole structure 500 and/or article of footwear 100 of this example includes: (a) at least a portion of a bladder system 200 (e.g., at least foot support bladder portion 210), (b) an outsole 502, and (c) a midsole 510. The bladder system 200 may comprise bladder systems of any of the types described below in conjunction with FIGS. 2A-3B. The outsole 502 may be formed from one or more outsole component parts and/or may be made of any desired outsole materials, including outsole component parts and/or outsole materials (e.g., rubbers, thermoplastic polyurethanes, other thermoplastics, etc.) conventionally known and used in the footwear arts. Outsole 502 may include one or more traction elements 504 at its ground-contacting surface 502G, e.g., including traction elements 504 of types conventionally known and used in the footwear arts (e.g., cleats, spikes, ridges, recesses, etc.). Outsole 502 of this example further includes a pump activator 506, e.g., located in a heel region of the sole structure 500, for activating a pump component of the bladder system 200 (e.g., compressing a bulb-type pump 220P), as will be described in more detail below.

Midsole 510 also may be formed from one or more component parts, including one or more foam elements (e.g., made from polyurethane foams, ethylvinylacetate foams, and/or other foam materials as are conventionally known and used in the footwear arts). While not a requirement, one or more of the foam components and/or other components of midsole 510 of this illustrated example may include or define one or more openings 510H through which a portion of the bladder system 200 is exposed (e.g., side edges of the foot support bladder portion 210 in this illustrated example). FIG. 1 illustrates a lateral heel based opening 510H and a lateral forefoot based opening 510H. More or fewer openings 510H (or no openings) may be provided in other specific examples. Additionally or alternatively, the medial side of the article of footwear 100 and sole structure 500 may include one or more heel based openings and/or forefoot based openings. Alternatively, the midsole 510 may include: (i) an opening or recess (e.g., at the medial side heel area) that allows exterior surfaces of fluid line 230 and/or fluid line 240 to be exposed, and/or (ii) support surfaces for supporting the surface of fluid line 230 and/or fluid line 240. In some examples of this technology, a foam component or other component may be provided between at least some portions of the facing surfaces of foot support bladder portion 210 and fluid reservoir portion 220 of the bladder system 200.

In the example sole structure 500 of FIG. 1, a portion of the bladder system 200 (e.g., the fluid reservoir portion 220) is located between the midsole 510 and outsole 502. Also, while not a requirement, in this illustrated example article of footwear 100 and sole structure 500, a portion of the bladder system 200 (e.g., the fluid reservoir portion 220) is exposed between the midsole 510 and outsole 502. Bladder system 200 may be formed from two (or more) thermoplastic elastomer layers (e.g., sheets or portions of a sheet) that are sealed together at one or more seams 208 (see FIGS. 1 and 2C). The bladder systems 200 can be formed from such thermoplastic elastomer material layers in conventional manners using conventional techniques, e.g., as are known and used in the footwear arts (such as welding techniques, bonding with adhesives, etc.).

Article of footwear 100 of this example further includes a heel component 520, e.g., engaged with the midsole 510, with another portion of the sole structure 500, and/or with the upper 102. Heel component 520 may be made from a rigid material, such as a plastic material and/or materials of the types used in conventional heel counter type structures. Heel component 520 of this illustrated example provides a base for pivotally engaging a switch member 400, e.g., at pivot support 402 (a similar pivot support 402 mount for switch member 400 may be provided on the medial side of this example sole structure 500 and article of footwear 100). The switch member 400 of FIG. 1 pivots on pivot support(s) 402 between the downward position shown in FIG. 1 and an upward position. See arrow A in FIG. 1. In the upward position, the base 404 of switch member 400 is moved upward from the position shown in FIG. 1, e.g., where it may engage and secure to latch member 522 provided as part of the heel component 520 (to hold the switch member 400 in place with respect to the heel component 520). While FIG. 1 shows the base 404 of switch member 400 having a recess 404R that extends over and past the projection 522P provided as latch member 522, other latching structural features may be provided in other specific examples of this aspect of the present technology (e.g., where switch member 400 includes a projection that fits into a recess provided in heel component 520, where the arms 406 of the switch member 400 engage a latch, etc.).

In the sole structure 500 and article of footwear 100 described above and shown in FIG. 1, at least one of the heel component 520 and/or the midsole 510 defines a recess 520R. Recess 520R of this example provides space to accommodate a fluid line portion 200P of bladder system 200 and a portion of the switch member 400. As will be described in more detail below, switch member 400 is used to switch the fluid line portion 200P of the bladder system 200 between an open configuration (as shown in FIG. 1) and a closed configuration (when the switch member 400 of FIG. 1 is moved to the upward and latched position).

U.S. Provisional Patent Appln. No. 63/604,559 entitled "Sole Structures and Articles of Footwear Including Bladder Systems with Closable Fluid Line" provides additional structural details of articles of footwear and/or sole structures, including switching members and the like, that may be used in accordance with aspects of the technology disclosed herein. Additionally or alternatively, the bladder system 200, upper 102, outsole 502, midsole 510, and/or article of footwear 100 may be formed from component parts and/or have constructions of the types described and illustrated in U.S. Pat. Nos. 11,206,896 B2, 11,234,485 B2, U.S. Provisional Patent Appln. No. 63/477,719, U.S. Provisional Patent Appln. No. 63/498,593, and/or U.S. Provisional Patent Appln. No. 63/541,431.

Figure 2A:
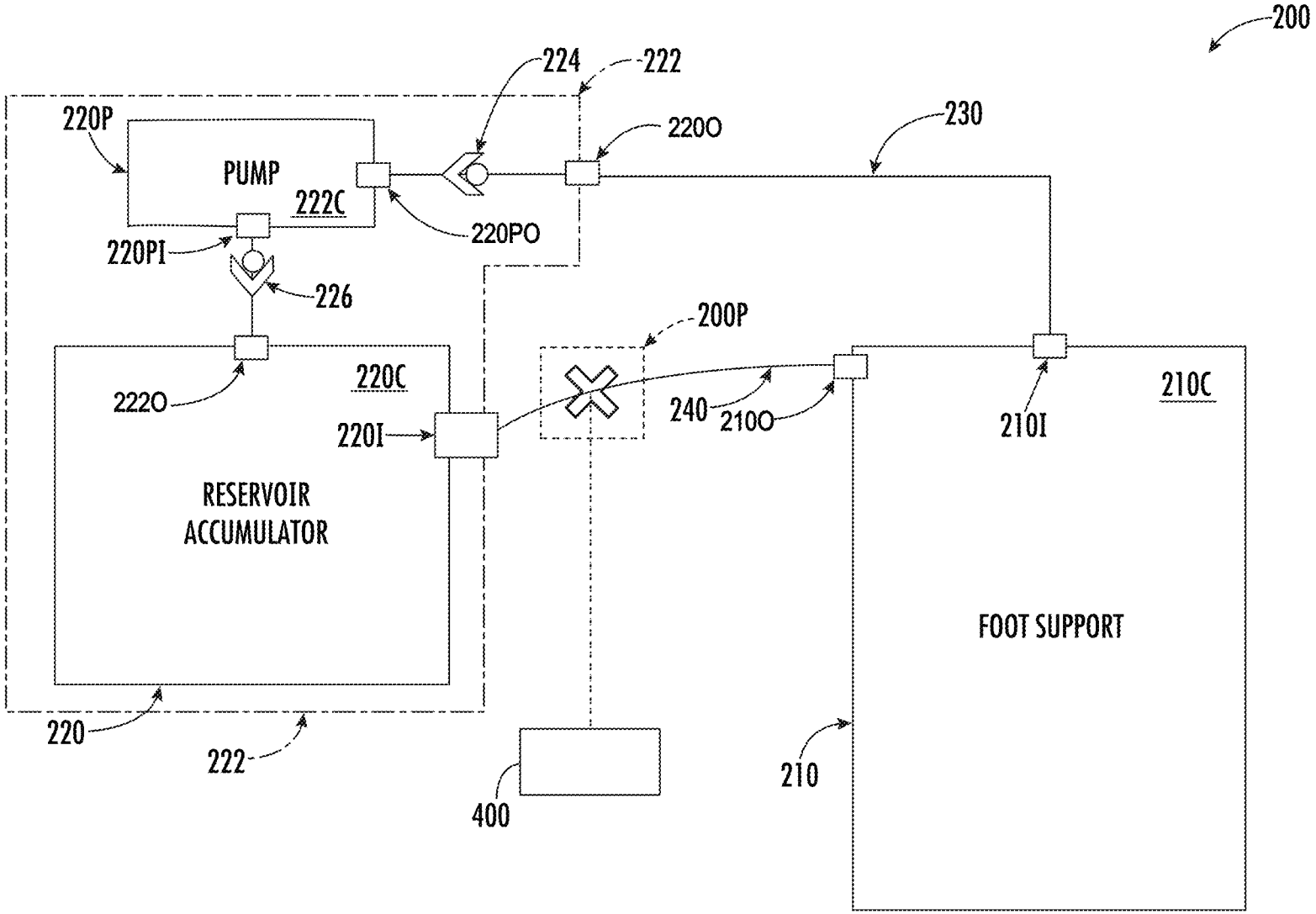
FIGS. 2A-2H provide various views illustrating a bladder system and its use in accordance with some examples of this technology.
Figure 2B:
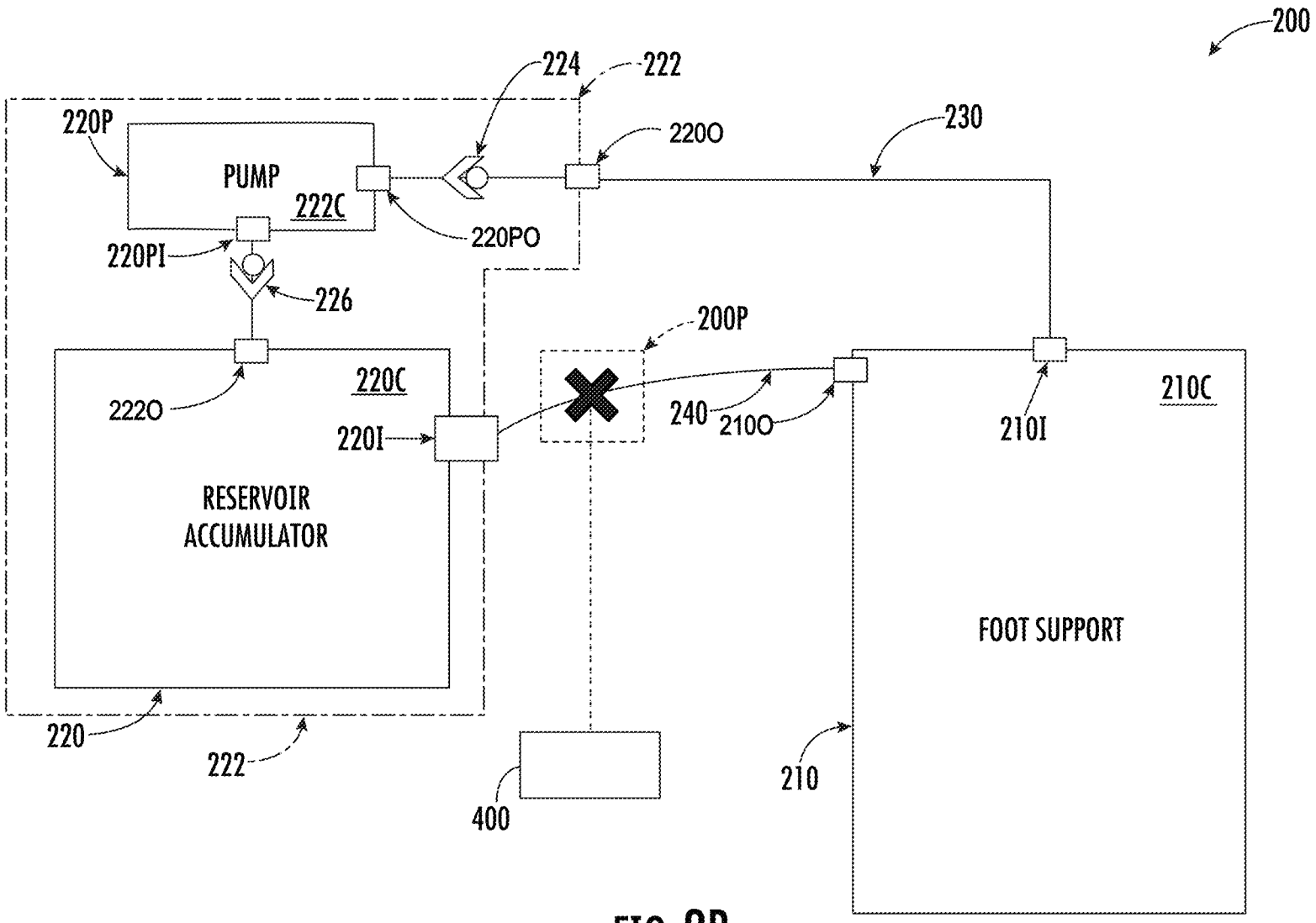
Figure 2C:
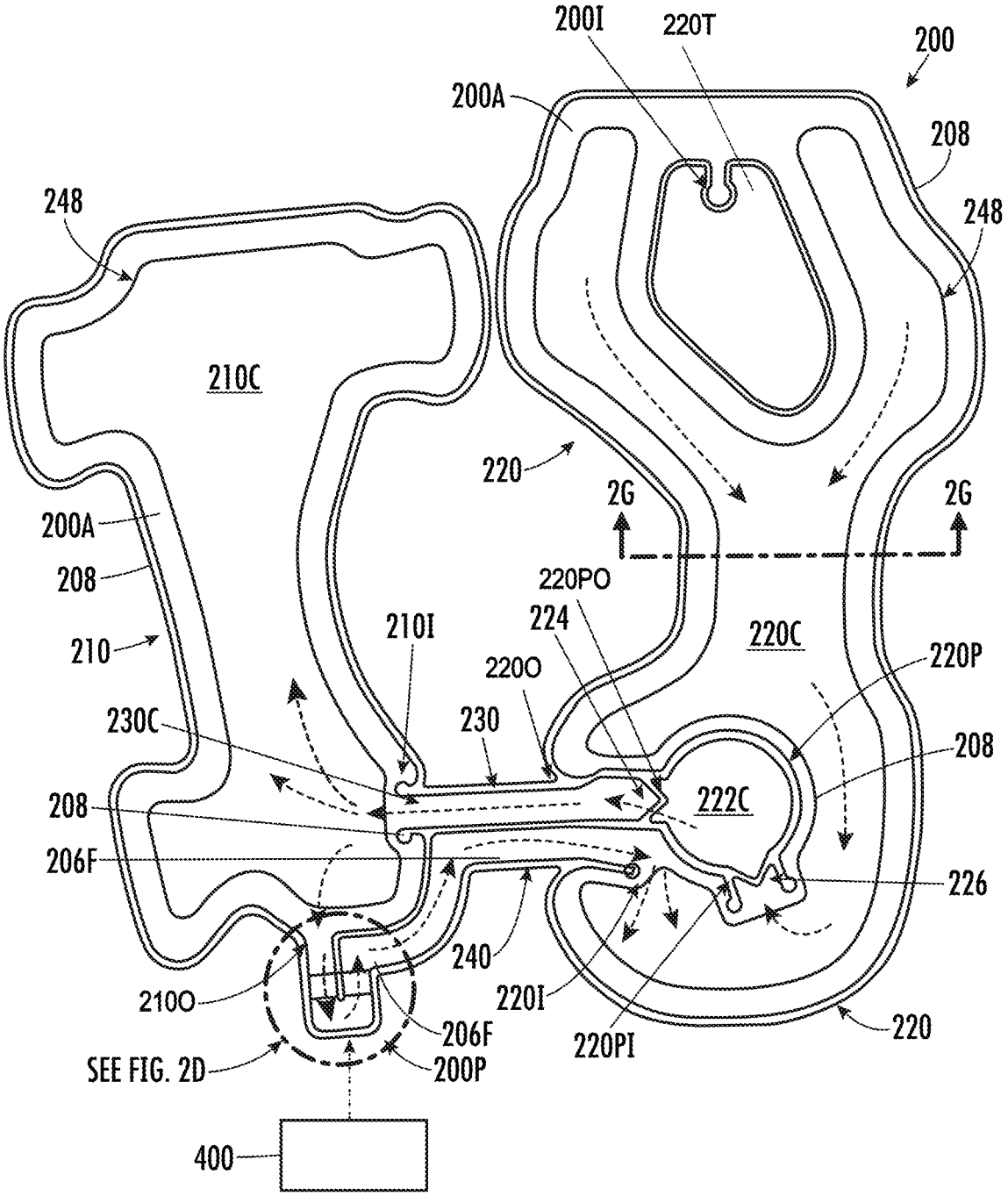
Figure 2D:
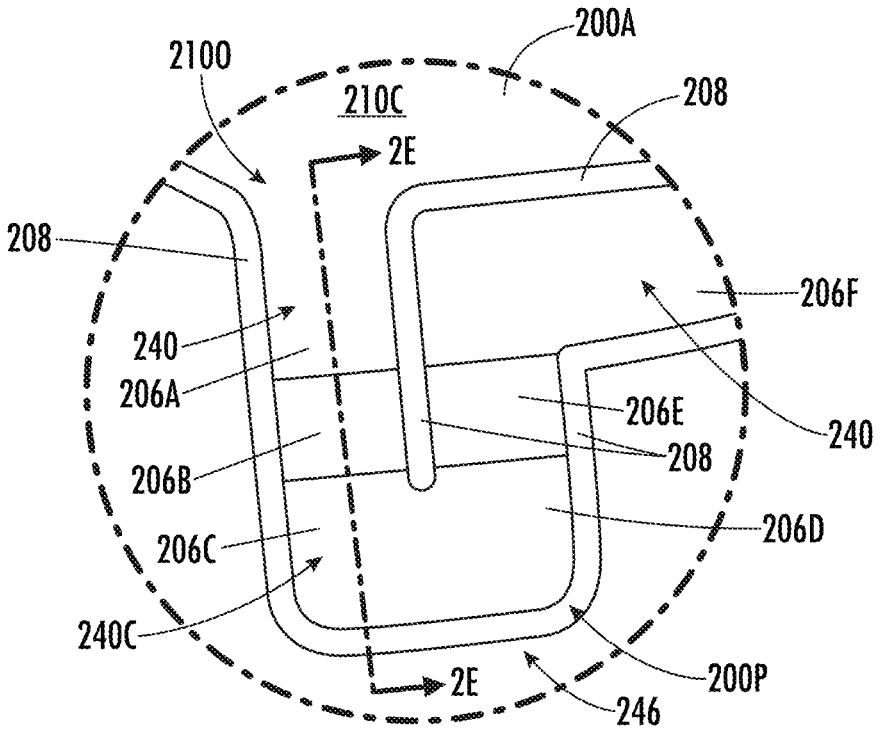
Figure 2E:
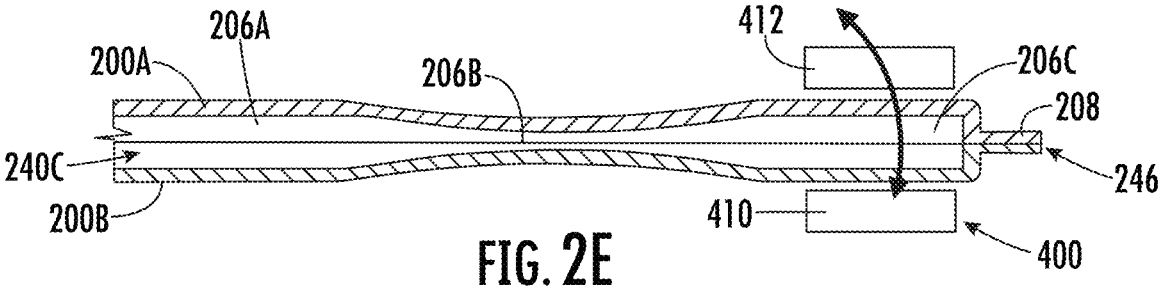
Figure 2F:
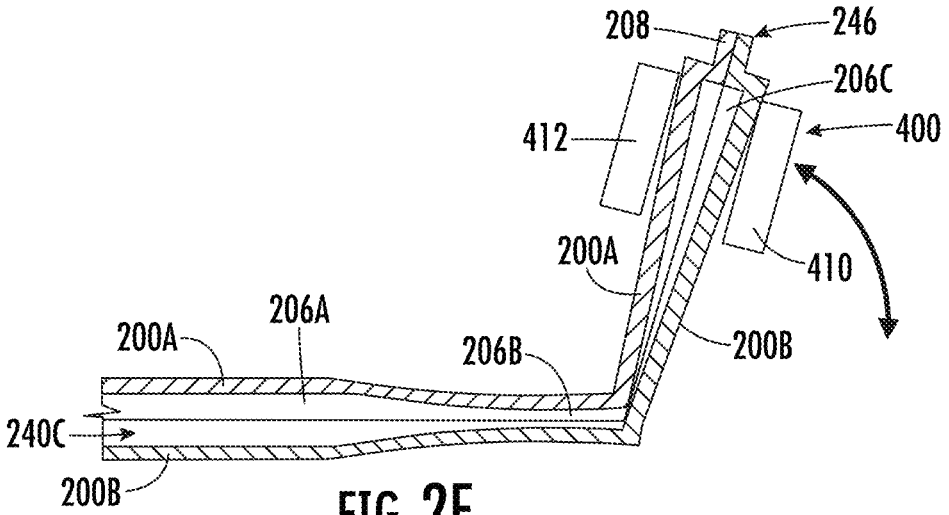
Figure 2G:
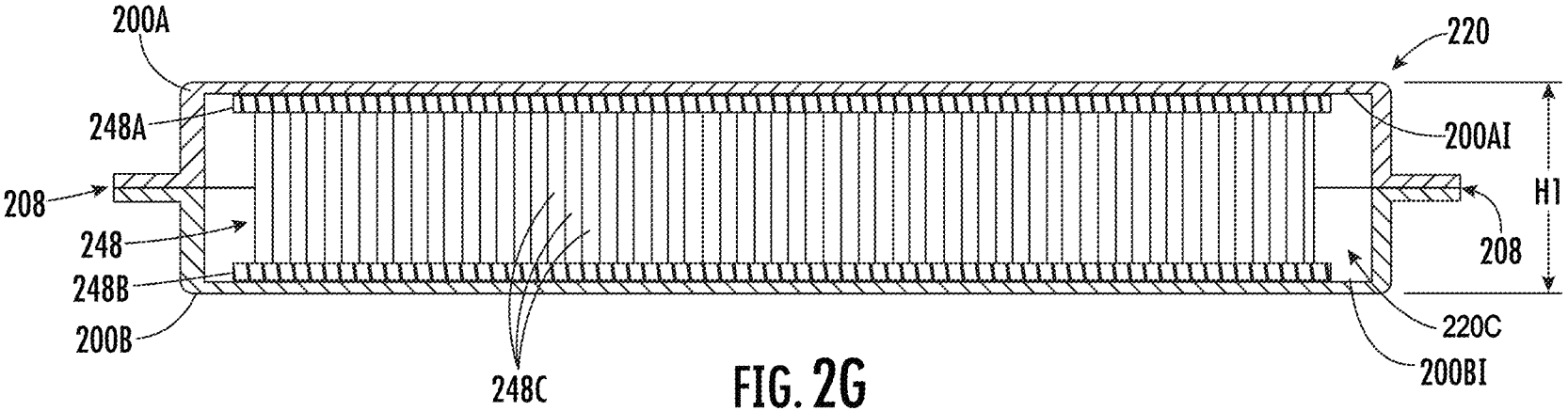
Figure 2H:
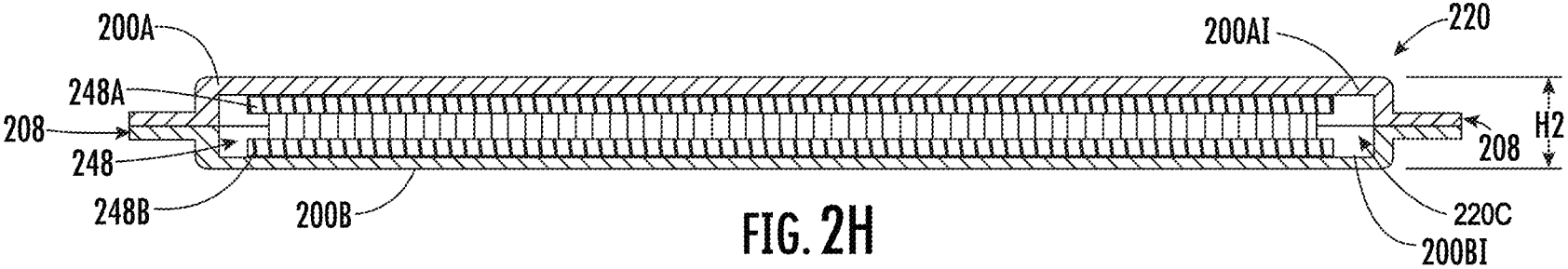

Aspects of this technology now will be described in more detail in conjunction with FIGS. 2A-2H. FIGS. 2A and 2B schematically illustrate features of a bladder system 200 that may be included in foot support systems, sole structures 500, and/or articles of footwear 100 in accordance with some aspects of this technology. FIG. 2C shows a top plan view of bladder system 200 prior to being incorporated into a sole structure 500 or article of footwear 100; FIG. 2D shows an enlarged view of the fluid line portion 200P shown encircled in FIG. 2C (the "flap"); FIG. 2E shows a cross sectional view of fluid line portion 200P taken along line 2E-2E in FIG. 2D in an open configuration; FIG. 2F shows a cross sectional view of fluid line portion 200P in a closed configuration; FIG. 2G shows a cross sectional view of fluid reservoir portion 220 taken along line 2G-2G in FIG. 2C with the bladder system 200 in a lower pressure foot support configuration (e.g., in which this example fluid reservoir portion 220 and foot support bladder portion 210 are at an "equalized" pressure); and FIG. 2H shows a cross sectional view of fluid reservoir portion 220 taken along line 2G-2G in FIG. 2C with the bladder system 200 in a higher pressure foot support configuration (e.g., in which fluid is moved out of this example fluid reservoir portion 220 and into foot support bladder portion 210). Where the same reference numbers are used in FIGS. 1-2H, the same or similar parts are being referenced.

First, the various portions of this example bladder system 200 will be described in conjunction with FIGS. 2A-2C. This example bladder system 200 includes four main regions or portions as follows: (a) a foot support bladder portion 210; (b) a fluid reservoir portion 220; (c) a first fluid line 230 (including its interior fluid channel 230C), e.g., for moving fluid from the fluid reservoir portion 220 to the foot support bladder portion 210; and (d) a second fluid line 240 (including its interior fluid channel 240C), e.g., for moving fluid from the foot support bladder portion 210 to the fluid reservoir portion 220. As further shown in FIG. 2C, this example bladder system 200 includes a pump 220P (e.g., a foot-activated pump, such as a bulb-type pump located in a heel support region of the bladder system 200) for moving fluid from the fluid reservoir portion 220 to the fluid line 230. The broken line arrows in FIG. 2C illustrate the direction of fluid flow in this example bladder system 200.

In the example of FIG. 2C, the pump 220P is formed within and/or as part of the fluid reservoir portion 220 of the bladder system 200 (and the pump 220P region may be at least partially surrounded by the fluid reservoir portion 220, as shown in FIG. 2C). These combined components are shown contained in dot-dash box 222 in FIGS. 2A and 2B. In some examples of this technology, however: (a) the pump 220P need not be included as part of the fluid reservoir portion 220, (b) the pump 220P need not be a foot-activated pump and/or a bulb-type pump (e.g., it could be formed as a separate component connected by fluid lines, etc.), and/or (c) the pump 220P need not be included in the heel support region (e.g., a foot-activated pump could be in a forefoot support region of a sole structure 500). Also, two or more foot activated pumps could be provided (e.g., connected in series), e.g., of the types described in U.S. Pat. No. 11,510,458 B2, which patent is entirely incorporated herein by reference.

Various sizes, shapes, and/or arrangements of foot support bladder portions 210 and fluid reservoir portions 220 may be used in specific examples of this technology. As illustrated in FIG. 2C, the foot support bladder portion 210 may include a heel support region, a midfoot support region, and a forefoot support region, e.g., for supporting at least portions of the plantar surface of a wearer's heel, midfoot, and forefoot. Additionally or alternatively, the fluid reservoir portion 220 may include a heel region, a midfoot region, and a forefoot region, e.g., underlying at least portions of the plantar surface of a wearer's heel, midfoot, and forefoot. When mounted in a sole structure 500 and/or article of footwear 100 as shown in FIG. 1, the foot support bladder portion 210 and fluid reservoir portion 220 may be moved with respect to one another from the configuration shown in FIG. 2C so that fluid lines 230, 240 curve in a vertical direction and the two major faces of foot support bladder portion 210 and fluid reservoir portion 220 shown in FIG. 2C directly face one another (optionally with a foam material or other material located between at least some portions of these facing major surfaces).

In some examples of this technology, as shown in FIGS. 1 and 2C, a portion 200P of fluid line 240 extends outward (e.g., rearward) from a heel portion (e.g., a rear heel portion) of the foot support bladder portion 210 and may form a flap through which the portion 200P of fluid line 240 extends. This portion 200P may form part of and continue from the seam 208 joining the thermoplastic elastomer layers forming the bladder system 200. As shown in FIG. 1, the flap including fluid line portion 200P of fluid line 240 may be at least partially exposed at the exterior of the sole structure 500 and/or article of footwear 100 structure (thus forming an "exposed flap").

In the configuration shown in FIG. 2A, the switch member 400 is in the open configuration (e.g., the downward position described above in conjunction with FIG. 1 and the open "X" in FIG. 2A), which corresponds to the "lower pressure foot support configuration" that will be described in more detail below. In the configuration shown in FIG. 2B, the switch member 400 is in the closed configuration (e.g., shown as the upward position in FIG. 1 and the blackened "X" in FIG. 2B), which corresponds to the "higher pressure foot support configuration" that will be described in more detail below. Additionally, this example bladder system 200 is a "closed system," e.g., the bladder system 200 has a fixed amount (e.g., mass) of fluid (e.g., gas, such as air or other gas, including gases conventionally known and used in foot support bladder systems) sealed within it, and the bladder system 200 does not bring in new fluid from the external environment and does not discharge fluid into the external environment. Fluid moves between the foot support bladder portion 210 and fluid reservoir portion 220 to change the foot support pressure in the foot support bladder portion 210. Alternatively, however, at least some aspects of this technology may be used in "open" bladder systems, e.g., bladder systems that bring in air (or other gas) from the external environment (e.g., via a pump (a manual pump (including a foot-activated pump or an electric pump) or compressor) and/or discharge air (or other gas) into the external environment to change foot support pressure in a foot support bladder.

FIG. 2A shows the bladder system 200 in a "lower pressure" foot support configuration, and FIG. 2B shows the bladder system 200 in a "higher pressure" foot support configuration. When switch member 400 is open as shown in FIG. 2A (with switch member 400 in the downward position shown in FIG. 1), fluid line 240 is open, and fluid freely flows around the entire bladder system 200 circuit as follows: (a) from foot-activated pump 220P, (b) through pump outlet 220PO, (c) through check valve 224, (d)

through fluid reservoir outlet 220O (if separate from the check valve 224), (e) into first fluid line 230, (f) through foot support bladder inlet 210I, (g) into foot support bladder portion 210 (into its interior chamber 210C), (h) through foot support bladder outlet 210O, (i) into second fluid line 240, (j) through fluid reservoir inlet 220I, (k) into fluid reservoir portion 220 (into its interior chamber 220C), (l) through fluid reservoir outlet 222O, (m) through check valve 226, (n) through pump inlet 220PI, and (o) back into pump 220P (e.g., into its interior chamber 222C). In use, check valve 226 (or other valve structure) prevents pumped fluid (e.g., from compression of bulb pump 220P) from re-entering the main reservoir volume of the fluid reservoir portion 220 via fluid reservoir outlet 222O, and check valve 224 (or other valve structure) prevents fluid from re-entering the pump 220P from the foot support bladder portion 210 (via fluid reservoir outlet 220O). After a step and compression of the foot-activated pump 220P's interior chamber 222C to expel fluid from the pump outlet 220PO, the interior chamber 222C of the pump 220P will re-expand and be refilled with fluid moving from the fluid reservoir portion 220 through check valve 226 for the next step and pump cycle.

When switch member 400 is closed, however, as shown in FIG. 2B (and with switch member 400 in the upward position shown in FIG. 1), fluid line 240 is closed and fluid flow around the circuit is disrupted. In that configuration—the "higher pressure foot support configuration"—fluid moves as follows: (a) from foot-activated pump 220P, (b) through pump outlet 220PO, (c) through check valve 224, (d) through fluid reservoir outlet 220O (if separate from the check valve 224), (e) into first fluid line 230, (f) through foot support bladder inlet 210I, and (g) into foot support bladder portion 210 (into its interior chamber 210C). After a step and compression of the foot-activated pump 220P's interior chamber 222C to expel fluid from the pump outlet 220PO, the interior chamber 222C of the pump 220P will re-expand and be refilled with fluid moving from the fluid reservoir portion 220 through check valve 226 for the next step and pump cycle (e.g., as long as fluid remains in the reservoir portion 220). Because fluid line 240 is closed and check valve 224 prevents fluid from backflowing into the pump 220P via pump outlet 220PO, fluid accumulates in the foot support bladder portion 210 (e.g., incrementally increasing gas mass and pressure in a step-by-step manner) and fluid becomes depleted in the fluid reservoir portion 220. This action increases fluid pressure in the foot support bladder portion 210 and decreases fluid pressure in the fluid reservoir portion 220.

The foot support bladder portion 210, when fully inflated, will define a first interior volume V1 (volume of interior chamber 210C) and the fluid reservoir portion 220, when fully inflated, will define a second interior volume V2 (volume of interior chamber 220C). These volumes may vary with respect to one another. In some examples of this technology, these volumes will satisfy at least one of the following relationships: $0.8 \times V2 \leq V1 \leq 1.2 \times V2$; and/or $0.9 \times V2 \leq V1 \leq 1.1 \times V2$. In some examples of this technology, V1 and V2 may be substantially equal (e.g., within ±2% of one another).

Additional aspects of this technology will be described below with additional reference to FIGS. 2D-2H. The bladder system 200 shown in FIG. 2C includes a first thermoplastic elastomer layer 200A joined to a second thermoplastic elastomer layer 200B at one or more seams 208 to form an interior fluid chamber (e.g., a continuous interior chamber) that includes: (a) the interior chamber 210C of foot support bladder portion 210; (b) the interior chamber 220C of the fluid reservoir portion 220; (c) the interior fluid channel 230C of first fluid line 230 (extending between the fluid reservoir portion 220 and the foot support bladder portion 210); (d) the interior fluid channel 240C of second fluid line 240 (extending between the foot support bladder portion 210 and the fluid reservoir portion 220); and (e) in at least some examples, the interior chamber 222C of pump 220P.

In at least some examples of this technology, all of these interior fluid chamber portions (e.g., the interior chamber 210C of foot support bladder portion 210, the interior chamber 220C of the fluid reservoir portion 220, the interior fluid channel of fluid line 230, the interior fluid channel 240C of fluid line 240, and (in at least some examples) the interior chamber 222C of pump 220P) may be formed as a single, unitary bladder component (e.g., formed from two thermoplastic elastomer layers 200A, 200B provided as part of one or more sheets of thermoplastic elastomer material). In such unitary bladder component structures, the fluid lines 230 and 240 are integrally formed with the foot support bladder portion 210 and the fluid reservoir portion 220. Thus, in production of such bladder systems 200, there is no need to fix separate fluid lines (e.g., tubing) to bladder ports (e.g., by welding, by adhesives, etc.) and there is no need to provide and incorporate any separate port hardware into the bladder structure. Such unitary constructions can simplify production, avoid use of adhesives, reduce costs, and/or help avoid formation of leaks. If needed, however, hardware for the valves 224 and/or 226 may be placed between the thermoplastic elastomer layers 200A and 200B prior to seam 208 formation and/or at another appropriate time in the production process and/or the valves 224 and/or 226 may be provided in another appropriate manner.

As shown in FIGS. 1, 2C, and 2D, a portion 200P of the fluid line 240 extends outward (e.g., rearward) from a heel portion (e.g., a rear heel portion) of the foot support bladder portion 210 and forms a flap (e.g., an exposed flap) through which the interior fluid channel 240C of fluid line 240 extends. This flap may extend from and form part of the seam 208 between thermoplastic elastomer layers 200A, 200B. Additional example features and properties of this fluid line portion 200P and flap now will be described.

First thermoplastic elastomer layer 200A and second thermoplastic elastomer layer 200B (formed from one or more sheets of thermoplastic elastomer material) are joined together (e.g., at one or more seams 208) to define an interior bladder chamber (e.g., including foot support bladder interior chamber 210C in this illustrated example). Fluid line 240 has a first end opening into and in fluid communication with the foot support bladder interior chamber 210C. The portion 200P of the fluid line 240 exiting the foot support bladder interior chamber 210C at foot support bladder outlet 210O (e.g., into the flap) includes: (i) a first fluid line region 206A having a first transverse cross sectional area (e.g., extending in a direction away from the foot support bladder interior chamber 210C), (ii) a second fluid line region 206B extending from the first fluid line region 206A (e.g., in the direction away from the foot support bladder interior chamber 210C), the second fluid line region 206B having a second transverse cross sectional area that is smaller than the first transverse cross sectional area, and (iii) a third fluid line region 206C extending from the second fluid line region 206B (e.g., in the direction away from the foot support bladder interior chamber 210C), the third fluid line region 206C having a third transverse cross sectional area that is greater than the second transverse cross sectional area (and optionally the same or substantially the same as the first transverse cross sectional area). Thus, the flap may include: (a) a forward portion (e.g., first fluid line region 206A) where a first end of fluid line 240 opens into and receives fluid from the foot support bladder chamber 210 (or, in other examples, from the fluid reservoir chamber 220) and (b) a rearward portion forming a free end 246 or edge of the flap.

In some examples of this technology, this portion 200P of the fluid line 240 (e.g., in the flap) may further include: (i) a fourth fluid line region 206D extending from the third fluid line region 206C (e.g., in a direction toward the foot support bladder interior chamber 210C), the fourth fluid line region 206D having a fourth transverse cross sectional area (which may be the same or substantially the same as the first and/or third cross transverse sectional areas and/or may be greater than the second transverse cross sectional area), and (ii) a fifth fluid line region 206E extending from the fourth fluid line region 206D (e.g., in the direction toward the foot support bladder interior chamber 210C), the fifth fluid line region 206E having a fifth transverse cross sectional area that is smaller than the fourth transverse cross sectional area (and which may be the same or substantially the same as the second transverse cross sectional area). This portion of the fluid line 240 (e.g., in the flap) further may include at least a portion of a sixth fluid line region 206F extending from the fifth fluid line region 206E, the sixth fluid line region 206F having a sixth transverse cross sectional area that is greater than the fifth transverse cross sectional area (and which may be the same or substantially the same as one or more of the first, third, and/or fourth transverse cross sectional areas).

"Transverse cross sectional area," as that term is used herein in this context, means an area enclosed by a fluid line and oriented in a direction perpendicular to the direction of fluid flow. The term "substantially the same" as used herein in this context means that the two areas being compared are within 10% of one another (e.g., A1=A2±10% and/or A2=A1±10%). In at least some examples of this technology, each of the first transverse cross sectional area, the second transverse cross sectional area, the third transverse cross sectional area, the fourth transverse cross sectional area (if present), and the fifth transverse cross sectional area (if present) may be less than 500 $mm^2$. The second transverse cross sectional area and/or the fifth transverse cross sectional area (if present) may be at least 10% smaller than the area(s) of one or more of the first transverse cross sectional area, the third transverse cross sectional area, and/or the fourth transverse cross sectional area (if present), and in some examples, at least 15% smaller, at least 20% smaller, at least 25% smaller, or even at least 30% smaller. Thus, the portion 200P of the fluid line 240 included in the flap may include an open interior fluid channel 240C within the flap, the open interior fluid channel 240C having: (a) a first arm (e.g., formed from first fluid line region 206A, second fluid line region 206B, and at least a portion of third fluid line region 206C), (b) a second arm (e.g., formed from at least a portion of the fourth fluid line region 206D, fifth fluid line region 206E, and at least a portion of sixth fluid line region 206F, if present), and (c) a base connecting the first arm and the second arm (e.g., where the base includes at least a portion of the third fluid line region 206C and/or the fourth fluid line region 206D). In this manner, the first arm will define a first thinned region of the open interior fluid channel 240C (e.g., corresponding to second fluid line region 206B) and the second arm will define a second thinned region of the open interior fluid channel 240C (e.g., corresponding to fifth fluid line region 206E). These thinned regions may be located adjacent one another (e.g., side-by-side) and may form a pre-crease or pre-bend region of fluid line 240 in the flap.

The second fluid line region 206B may be located adjacent the fifth fluid line region 206E (e.g., side-by-side), and optionally separated therefrom by a portion of a seam 208. Thus, a portion of a seam 208 may define adjacent sides of each of the second fluid line region 206B and the fifth fluid line region 206E. Additionally or alternatively, the first fluid line region 206A may be located adjacent the sixth fluid line region 206F, and optionally separated therefrom by a portion of a seam 208. Thus, a portion of a seam 208 (e.g., the same seam 208 mentioned above) may define adjacent sides of the first fluid line region 206A and the sixth fluid line region 206F. Similarly, if desired, the third fluid line region 206C may be located adjacent the fourth fluid line region 206D, and optionally separated therefrom by a portion of that same seam 208. Thus, a portion of this seam 208 may define adjacent sides of the third fluid line region 206C and the fourth fluid line region 206D.

In some examples of this technology, a linear fluid line length of fluid line 240 within the flap (e.g., from a beginning of the first fluid line region 206A (at the outlet 210O of the foot support bladder portion 210) at least through an end of the fifth fluid line region 206E) may be less than 100 mm long, and in some examples, less than 90 mm, less than 75 mm, less than 65 mm long, or even less than 50 mm long. Also, in the example structure shown in FIG. 2D, the portion 200P of the fluid line 240 included within the flap (e.g., at least a portion of the first fluid line region 206A, the second fluid line region 206B, the third fluid line region 206C, the fourth fluid line region 206D, and/or the fifth fluid line region 206E) may form a square or rectangular shaped tab or flap that extends outward from the first interior bladder chamber (e.g., the foot support bladder interior chamber 210C). Additionally or alternatively, in at least some examples of this technology, the interior channel 240C forming the fluid line through the flap area (e.g., including two or more of the fluid line regions 206A-206F described above) may form a U-shaped channel.

The sixth fluid line region 206F may extend to and/or otherwise be in fluid communication with the interior chamber of another bladder portion, e.g., the interior chamber 220C of the fluid reservoir portion 220 in the illustrated example of FIGS. 1-2H. Thus, as shown in FIG. 2C, the sixth fluid line region 206F may extend from a medial heel region of the fluid reservoir portion 220 to the portion 200P of fluid line 240 included in the flap. At least a portion of the sixth fluid line region 206F of fluid line 240 may lie adjacent and extend along (e.g., in parallel with) at least a portion of fluid line 230 (and optionally is separated therefrom by a segment of a seam 208). These adjacent portions of the sixth fluid line region 206F and fluid line 230 may be located in a heel region and/or a midfoot region (e.g. medial heel and/or medial midfoot region(s)) of the bladder system 200, sole structure 500, and article of footwear 100. Additionally or alternatively, these adjacent portions of the sixth fluid line region 206F and fluid line 230 may form a bend region of bladder system 200, e.g., to support movement (e.g., rotation) of the foot support bladder portion 210 with respect to the fluid reservoir portion 220 (e.g., so that the foot support bladder portion 210 overlies the fluid reservoir portion 220 in the final assembled sole structure 500 and article of footwear 100 as shown in FIG. 1). If necessary or desired, structures of the types described in one or more of U.S. Pat. Nos. 11,206,896 B2, 11,234,485 B2, U.S. Provisional Patent Appln. No. 63/477,719, U.S. Provisional Patent Appln. No. 63/498,593, and U.S. Provisional Patent Appln. No. 63/541, 431 may be provided to support the fluid lines 230, 240 and/or to prevent undesired pinching or closure of the fluid lines 230, 240 at these adjacent portions of the sixth fluid line region 206F and fluid line 230.

In at least some examples of this technology, the second fluid line region 206B and/or the fifth fluid line region 206E (when present)—the region(s) having the smaller transverse cross sectional area(s)—may form a pre-crease or pre-bend region for closing the fluid line 240. As shown in FIGS. 2E and 2F (noting also FIG. 1), switch member 400 may include a contact surface 410, e.g., located beneath the flap that includes portion 200P of fluid line 240. When the switch member 400 is moved upward, contact surface 410 will pull the free end 246 of the fluid line portion 200P upward, as shown in the transition from FIG. 2E to FIG. 2F. This action pinches (or kinks) interior fluid channel 240C closed, thereby changing the fluid line 240 from an open configuration to a closed configuration and thereby stopping fluid flow through fluid line 240. This action changes the bladder system 200 from the lower pressure foot support configuration shown in FIGS. 2A and 2E to the higher pressure foot support configuration shown in FIGS. 2B and 2F. If necessary or desired, the switch member 400 may include another contact surface 412, this one located above the flap that includes portion 200P of fluid line 240. This contact surface 412, when present, can help push the free end 246 of the flap back downward (and help assure that the interior fluid channel 240C opens back up).

The flap through which the portion 200P of fluid line 240 extends may have a relatively small size and/or volume, e.g., compared to the sizes and/or volumes of the foot support bladder portion 210's interior chamber 210C and/or the fluid reservoir portion 220's interior chamber 220C. As some more specific examples, the flap (e.g., the portion 200P including at least the first fluid line region 206A, the second fluid line region 206B, and the third fluid line region 206C described above) may define an area of less than 2000 $mm^2$ (and in some examples, an area of less than 1600 $mm^2$, less than 1200 $mm^2$, and even less than 1000 $mm^2$). As some additional examples, the fluid line 240 within the flap (e.g., the portion 200P including at least the first fluid line region 206A, the second fluid line region 206B, the third fluid line region 206C, the fourth fluid line region 206D, and the fifth fluid line region 206E described above) may be sized within any of the area ranges described above. Additionally or alternatively, the flap (including the portion of the fluid line 240 within it) may have a thickness of less than 20 mm (and in some examples, of less than 16 mm, less than 12 mm, or even less than 10 mm) through at least 75% of the flap's surface area. These thickness size ranges may be present through at least 80%, at least 85%, at least 90%, at least 95%, or even over 100% of the flap surface area. Still additionally or alternatively, the interior fluid channel 240C of the fluid line 240 extending through the flap (e.g., from a beginning of the first fluid line region 206A (at the outlet 210O of the foot support bladder portion 210) through an end of the fifth fluid line region 206E) may enclose a volume of less than 7500 $mm^3$, and in some examples, less than 6000 $mm^3$, less than 5000 $mm^3$, or even less than 4000 $mm^3$. Still additionally or alternatively, the interior fluid channel 240C of the fluid line 240 through the flap (e.g., from a beginning of the first fluid line region 206A (at the outlet 210O of the foot support bladder portion 210) through an end of the fifth fluid line region 206E) may enclose a volume that is: (a) less than 1% (and in some examples, less than 0.5%, less than 0.25%, less than 0.1%, or even less than 0.05%) of the volume V1 defined within the foot support bladder portion 210's interior chamber 210C and/or (b) less than 1% (and in some examples, less than 0.5%, less than 0.25%, less than 0.1%, or even less than 0.05%) of the volume V2 defined within the fluid reservoir portion 220's interior chamber 220C.

Additional features and uses of some examples of this technology will be described in more detail below with additional reference to FIGS. 2G and 2H. FIG. 2G shows a cross sectional view of fluid reservoir portion 220 taken along line 2G-2G in FIG. 2C with the bladder system 200 in a lower pressure foot support configuration (e.g., in which the fluid reservoir portion 220 and the foot support bladder portion 210 of this example are at an "equalized" pressure and switch member 400 is in the open position). FIG. 2H shows a cross sectional view of fluid reservoir portion 220 taken along line 2G-2G in FIG. 2C with the bladder system 200 in a higher pressure foot support configuration and switch member 400 is in the closed position (e.g., after fluid is moved out of the fluid reservoir portion 220 and into the foot support bladder portion 210). FIGS. 2G and 2H further illustrate that the bladder system 200 (e.g., fluid reservoir portion 220) may include one or more interior tensile elements 248, e.g., to help control the shape of the bladder system 200 when inflated. The foot support bladder portion 210 also may include one or more interior tensile elements 248 of this type (see also FIG. 2C). Tensile elements 248 may be made of materials and constructions conventionally known and used in the footwear arts.

As some more specific examples, the interior tensile element(s) 248 of this example include: (i) a first base element 248A (e.g., a fabric component) attached to an interior surface 200AI of thermoplastic elastomer layer 200A (e.g., by an adhesive); (ii) a second base element 248B (e.g., a fabric component) attached to an interior surface 200BI of thermoplastic elastomer layer 200B (e.g., by an adhesive); and (iii) a plurality of flexible connecting elements 248C (e.g., threads, fibers, yarns, spacer mesh, etc.) extending between and connecting the first base element 248A and the second base element 248B. Thus, when the fluid reservoir portion 220 is inflated, as shown in FIG. 2G, the connecting elements 248C may limit the degree to which the fluid reservoir portion 220 can expand because connecting elements 248C limit the distance that base elements 248A and 248B (and the connected thermoplastic elastomer layers 200A, 200B, respectively) can separate from one another. In this manner, the interior tensile element(s) 248 can control the shape of inflated bladder portions in which they are included. Additionally or alternatively, internal welds or connections (where interior surface 200AI of thermoplastic elastomer layer 200A is welded or otherwise fixed to interior surface 200BI of thermoplastic elastomer layer 200B) may be provided for shape control purposes.

When switch member 400 is in the open configuration (e.g., as shown in FIGS. 1 and 2A), pressure is equalized throughout this example bladder system 200, the foot support bladder portion 210 is in a lower pressure foot support configuration, and the fluid reservoir portion 220 is in an expanded configuration as shown in FIG. 2G. At some point in time, switch member 400 will be moved to change fluid line 240 from the open configuration to the closed configuration (e.g., moving switch member 400 to the upper position in FIG. 1 and changing bladder system 200 from the FIG. 2A configuration to the FIG. 2B configuration). Once this change is made, fluid line 240 will be pinched closed (e.g., at the flap as shown in FIG. 2F). Then, as the user walks (activating foot pump 220P via activator 506 in this example), fluid will incrementally move (step-by-step) from the fluid reservoir portion 220 to the foot support bladder portion 210 and stay in the foot support bladder portion 210 (because fluid line 240 is closed and check valve 224 prevents backflow into the pump 220P).

As fluid moves into the foot support bladder portion 210, pressure will increase in the foot support bladder portion 210, e.g., because any substantial volume change may be limited by tensile element(s) 248 contained therein. But, as fluid moves out of the fluid reservoir portion 220, pressure will decrease in the fluid reservoir portion 220. Eventually, if and when sufficient fluid is moved out, the fluid reservoir portion 220 may begin to collapse and decrease in height. FIGS. 2G and 2H illustrate fluid reservoir portion 220 changing in height from H1 to H2 as fluid moves out of fluid reservoir portion 220 and into foot support bladder portion 210. Fluid may continue to be pumped out of fluid reservoir portion 220 (e.g., via foot activated pump 220P) until the fluid reservoir portion 220 is empty (or nearly empty). In some examples of this technology, such as in the article of footwear 100 structure shown in FIG. 1, this height decrease in fluid reservoir portion 220 may be observed visually (e.g., because the fluid reservoir portion 220 is visible and/or exposed in the sole structure 500 and/or because the sole structure 500 height change is otherwise made visibly observable).

When the bladder system 200, sole structure 500, and article of footwear 100 are in the configuration shown in FIG. 2H, movement of the switch member 400 from the closed configuration (the upward position) to the open configuration (the downward position) in this example will switch the bladder system 200, sole structure 500, and article of footwear 100 from the higher pressure foot support configuration to the lower pressure foot support configuration. In at least some examples of this technology, this change will open fluid line 240 and equalize pressure throughout the bladder system 200. Further, in some examples of this technology, this change will be accompanied by (a) a change in foot support pressure (from harder to softer) and (b) a height change in the fluid reservoir portion 220 (from H2 to H1). A height change also may be observed in the overall sole structure 500 and article of footwear 100. In at least some examples of this technology, the foot support pressure change (from harder to softer) and the height change may take place substantially instantaneously (e.g., in less than 2 seconds after the switch member 400 is moved to the open configuration (downward position). Alternatively, if desired, fluid flow rate controllers and/or other ways of slowing fluid transfer through fluid lines 230, 240 may be provided to control the rate at which the bladder system 200, sole structure 500, and article of footwear 100 change between these conditions, e.g., to produce a more gradual pressure change and/or height change.

In at least some examples of this technology, the entire bladder system 200 may be formed from two layers 200A, 200B of thermoplastic elastomer material (e.g., one or more thermoplastic elastomer sheets welded together via one or more seams 208 in manners known and used in the art). In such structures, the entire interior of the bladder system 200 (e.g., interior chamber 210C, interior chamber 220C, interior fluid channel 230C of fluid line 230, interior fluid channel 240C of fluid line 240, and pump interior chamber 222C) may be in fluid communication with one another. A single continuous perimeter seam 208 may extend completely around the exterior perimeter of the bladder system 200 where the layers 200A and 200B meet and are fixed together, and this single continuous perimeter seam 208 may extend to form and/or define at least portions of: (a) the interior chamber 210C, (b) the interior chamber 220C, (c) the interior fluid channel 230C of fluid line 230, and (d) the interior fluid channel 240C of fluid line 240. Additionally or alternatively, as shown in FIGS. 2C and 2D, the perimeter seam 208 may extend continuously from a region forming an exterior edge of the interior chamber 210C of foot support bladder portion 210 to a region forming the exterior edge of the flap including fluid line portion 200P of fluid line 240. This same continuous seam 208 may extend to form the remainder of the flap, the outside edge of fluid line 240, and the exterior edge of the interior chamber 220C of fluid reservoir portion 220. This same continuous seam 208 also may extend to form the outside edge of fluid line 230 and the remainder of the exterior edge of interior chamber 210C. Additionally or alternatively, as further shown in FIGS. 2C and 2D, the seams 208 may be formed such that the interior chambers 210C and 220C extend continuously to form (e.g., to morph into) the interior fluid channels 230C and 240C of fluid lines 230 and 240, respectively. Such continuous structures may avoid the need for separate port component hardware parts for attaching separate fluid lines 230, 240 (e.g., as tubing) to the foot support bladder portion 210 and fluid reservoir portion 220. Additional interior seams may be provided in the bladder system 200, e.g., to define the pump interior chamber 222C, to separate fluid lines 230 and 240 from one another and/or from interior chamber(s) 210 and/or 220, and/or for shape control, etc. Any necessary hardware for the valves 224 and/or 226 may be placed at appropriate locations at an appropriate time in the production process, e.g., before layers 200A and 200B are connected to form seam 208.

A single inflation port 2001 opening into one of these interior fluid chambers of the bladder system 200 (opening into fluid reservoir interior chamber 220C in the example of FIG. 2C) may be provided and may be configured to inflate each of the foot support bladder portion 210, the fluid reservoir portion 220, fluid line 230, and fluid line 240 (and pump chamber interior 222C). Once inflated, the port 2001 may be sealed, and the bladder system 200 may function as a closed, fluid-tight system.

Figure 3A:
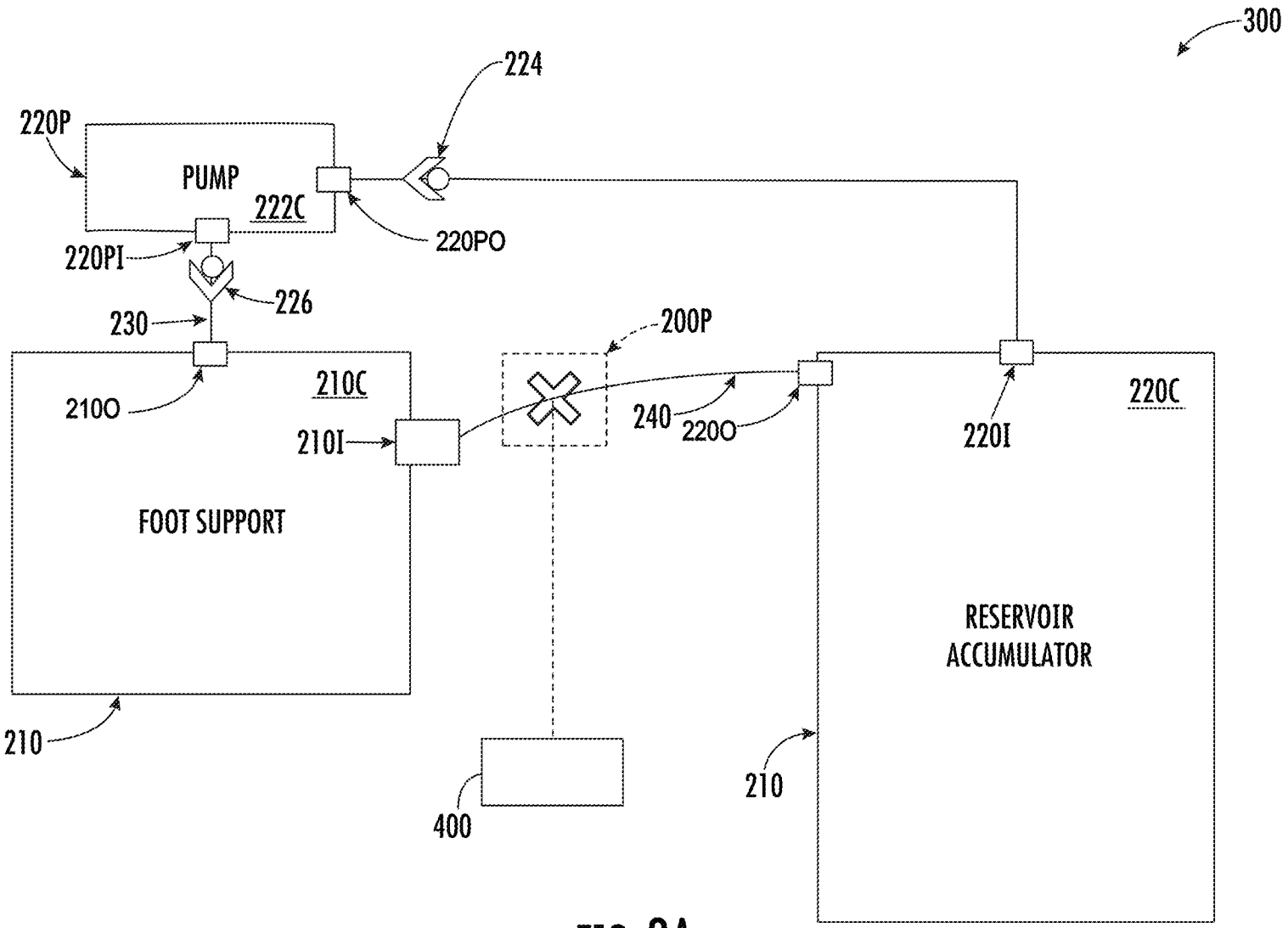
FIGS. 3A and 3B provide various views of another bladder system and its use in accordance with some examples of this technology.
Figure 3B:
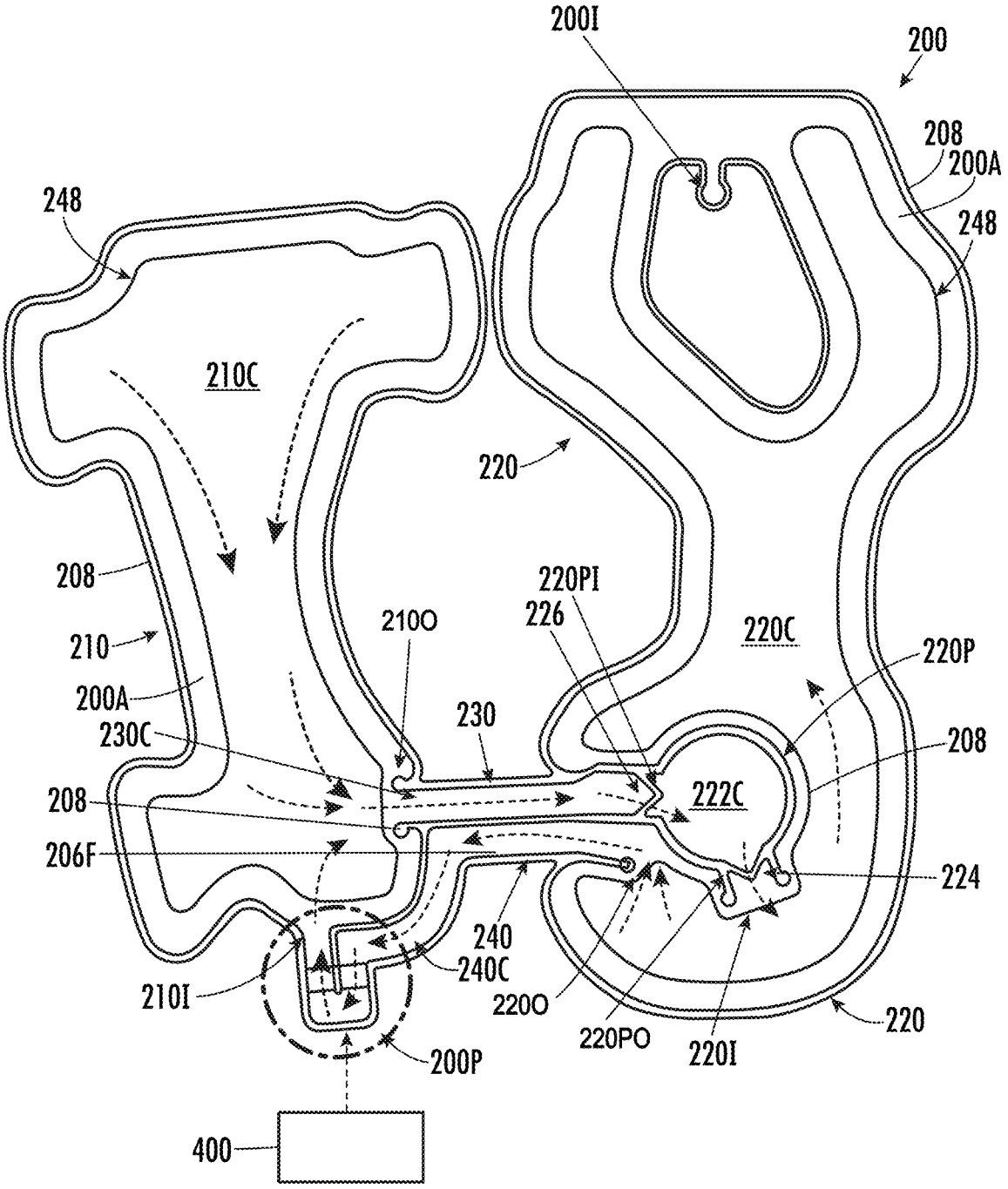

FIGS. 3A and 3B are views similar to FIGS. 2A and 2C, respectively, and these figures illustrate components and arrangements of another example bladder system 300 in accordance with aspects of this technology. Where the same reference numbers are used in FIGS. 3A and 3B as used in other figures herein, the same or similar parts and being referenced, and much of the overlapping description may be omitted.

The bladder system 300 of FIGS. 3A and 3B may be considered similar to those described above except the pump 220P and valves 224 and 226 are configured to move fluid in the opposite direction from the direction shown in FIG. 2C. Thus, as shown in FIGS. 3A and 3B, pump 220P moves fluid from the foot support bladder portion 210 into the fluid reservoir portion 220, e.g., in response to a user's steps compressing pump chamber 222C. The bladder system 300 of FIGS. 3A and 3B may be incorporated into sole structures 500 and/or article of footwear 100 structures, perform in similar manners, and/or use the same types of parts as those described above for FIGS. 1-2H.

FIG. 3A shows the bladder system 300 in a higher pressure foot support configuration with switch member 400 open (and thus, with fluid line 240 open). In this example bladder system 300, when switch member 400 is closed, fluid line 240 is closed, and fluid pumps out of the foot support bladder portion 210 and into the fluid reservoir portion 220. This action places foot support bladder portion 210 in a lower pressure foot support configuration.

When switch member 400 is open as shown in FIG. 3A (with switch member 400 in the downward position shown in FIG. 1), fluid line 240 is open. In this open configuration, fluid freely flows around the entire bladder system 300 circuit as follows: (a) from foot-activated pump 220P, (b) through pump outlet 220PO, (c) through check valve 224, (d) through fluid reservoir inlet 220I (if separate from the check valve 224), (e) into fluid reservoir portion 220 (into its interior chamber 220C), (f) into fluid reservoir outlet 220O, (g) into fluid line 240, (h) through foot support bladder inlet 210I, (i) into foot support bladder portion 210 (into its interior chamber 210C), (j) through foot support bladder outlet 210O, (j) into fluid line 230, (j) through check valve 226, (k) through pump inlet 220PI, and (o) back into pump 220P (e.g., into its interior chamber 222C). In use, check valve 226 (or other valve structure) prevents pumped fluid (e.g., from compression of bulb pump 220P) from re-entering fluid line 230 and/or interior chamber 210C of the foot support bladder portion 210 via the foot support bladder outlet 210O, and check valve 224 (or other valve structure) prevents fluid from re-entering the pump 220P from the fluid reservoir portion 220 (via fluid reservoir inlet 220I). After a step and compression of the foot-activated pump 220P's interior chamber 222C to expel fluid from the pump outlet 220PO, the interior chamber 222C of the pump 220P will be refilled with fluid moving from the foot support bladder portion 210, through fluid line 230 and check valve 226 for the next step and pump cycle.

When switch member 400 is closed (with switch member 400 in the upward position shown in FIG. 1), fluid line 240 is closed. In this orientation, fluid flow around the circuit is disrupted. In that configuration—the lower pressure foot support configuration in this example—fluid moves as follows: (a) from foot-activated pump 220P, (b) through pump outlet 220PO, (c) through check valve 224, (d) through fluid reservoir inlet 220I (if separate from the check valve 224), and (e) into fluid reservoir portion 220 (into its interior chamber 220C). After a step and compression of the foot-activated pump 220P's interior chamber 222C to expel fluid from the pump outlet 220PO, the interior chamber 222C of the pump 220P will be refilled with fluid moving from the foot support bladder portion 210, through fluid line 230 and check valve 226 for the next step and pump cycle. Because fluid line 240 is closed, fluid accumulates in the fluid reservoir portion 220 (e.g., incrementally increasing in a step-by-step manner) and fluid becomes depleted in the foot support bladder portion 210. This action decreases fluid pressure in the foot support bladder portion 210 and increases fluid pressure in the fluid reservoir portion 220. When switch member 400 is moved to open fluid line 240, pressure equalizes throughout this example bladder system 300 (e.g., substantially instantaneously or in a more controlled manner using flow control devices as described above).

FIG. 1 shows a switch member 400 mounted to an article of footwear 100 (e.g., to a heel component 520) to pinch fluid line 240 closed, e.g., as discussed above in conjunction with FIGS. 2E and 2F. If desired, however, other ways of pinching fluid line 240 closed may be used without departing from this technology. For example, a clamp, clip, or stopcock type structure could be provided at or near fluid line portion 200P to collapse fluid line 240 (e.g., and pinch it closed). As another example, rather than a pivoting switch member 400, the switch member 400 could be slidably mounted on a heel component 520 (and/or to the upper 102 and/or sole structure 500). As still other examples, if desired, rather than the manual switch member 400 illustrated in FIG. 1, electronic controlled switching systems may be used to open and close fluid line 240 (e.g., electronic controls of the types described in U.S. Pat. Nos. 11,206,896 B2, 11,234,485 B2, and/or U.S. Provisional Patent Appln. No. 63/541,431).

Also, while the example bladder systems 200, 300 shown in FIGS. 1-3B show the flap including the portion 200P of fluid line 240 extending outward from a surface of the foot support bladder portion 210, if desired, the flap and/or portion 200P of fluid line 240 could be provided at other portions of the overall bladder systems 200, 300. For example, if desired, the flap portion may extend outward from the fluid reservoir portion 220 of bladder systems 200, 300 and/or the first fluid line region 206A of portion 200P of fluid line 240 may directly open into the interior chamber 220C of the fluid reservoir portion 220 of bladder systems 200, 300.

Further, while FIG. 1 shows recess 520R, fluid line portion 200P, and switch member 400 contact surfaces 410, 412 located at a rear heel region of the sole structure 500 and article of footwear 100, these (or similar) components may be provided at other locations in the sole structure 500 and/or article of footwear 100, such as at a medial side heel region, at a lateral side heel region, at a medial side midfoot region, at a lateral side midfoot region, at a medial side forefoot region, at a lateral side forefoot region, and/or at a forward toe region.

The terms "higher pressure foot support configuration" and "lower pressure foot support configuration" as used herein mean that the pressures are higher and lower relative to one another (e.g., the "higher pressure foot support configuration" is at a higher pressure than the "lower pressure foot support configuration" and the "lower pressure foot support configuration" is at a lower pressure than the "higher pressure foot support configuration"). While other ranges are possible, in some examples of this technology, the "lower pressure foot support configuration" may have the foot support bladder portion 210 at a pressure of less than 20 psi, less than 15 psi, less than 12 psi, between 8 psi and 20 psi, and/or between 10 psi and 20 psi. Additionally or alternatively, while other ranges are possible, in some examples of this technology, the "higher pressure foot support configuration" may have the foot support bladder portion 210 at a pressure of at least 15 psi, at least 18 psi, at least 20 psi, at least 25 psi, at least 28 psi, between 15 psi and 35 psi, between 18 and 35 psi, and/or between 20 psi and 30 psi.

Finally, while the figures herein show article of footwear 100 and bladder system 200 having specific sizes, shapes, and ornamental appearances, many variations in the sizes, shapes, and/or ornamental appearances of the various parts and combinations of parts may be provided without departing from this technology. For example, a sole structure 500 need not include one or more (or any) of the openings 510H, and/or the openings 510H, if present, may have a wide variety of sizes, shapes, locations, relative locations, and the like. Recess 520R and/or fluid line portion 200P (including the flap) also may have a wide variety of sizes, shapes, locations, and the like. Additionally or alternatively, recess 520R could be omitted, and a switch member may engage fluid line portion 200P at a location within the interior of a sole structure 500 and/or article of footwear 100 (and optionally in a manner such that the fluid line portion 200P is not visible at the exterior of the sole structure 500 or article of footwear 100). Switch member 400, e.g., including recess 404R and/or the latch member 522 with which it engages, also may have a wide variety of sizes, shapes, arrangements of components, and latch interacting parts that would still be able to interact with a fluid line portion 200P and latch in the desired manner. Any desired type of outsole 502 also may be present (e.g., with many different sizes, shapes, arrangements, and orientations of traction elements 504). Bladder system 200's foot support bladder portion 210, fluid reservoir portion 220, fluid line 230, and fluid line 240 may have a wide variety of sizes; shapes; orientations; relative sizes, shapes, and orientations; locations; relative locations; and arrangements without departing from this technology. In general, the ornamental appearances of the various footwear 100, sole structure 500, and bladder system 200 parts and portions illustrated in the drawings are not essential to their functions, as footwear 100 and bladder system 200 parts and portions having many different appearances may be provided and still perform the desired functions in the desired manners as described above.

III. CONCLUSION

The present technology is disclosed above and in the accompanying drawings with reference to a variety of embodiments. The purpose served by the disclosure, however, is to provide an example of the various features and concepts related to this technology, not to limit the scope of the claimed invention. One skilled in the relevant art will recognize that numerous variations and modifications may be made to the embodiments described above without departing from the scope of the presently claimed invention, as defined by the appended claims.

For avoidance of doubt, this invention includes within its scope at least the subject matter defined in the following numbered "Clauses:"

Clause 1. A bladder system for containing a fluid, the bladder system comprising:

a foot support bladder portion, wherein a heel portion or a midfoot portion of the foot support bladder portion forms an outwardly extending flap;

a fluid reservoir portion;

a first fluid line for moving fluid from the fluid reservoir portion to the foot support bladder portion; and a second fluid line for moving fluid from the foot support bladder portion to the fluid reservoir portion, wherein a first portion of the second fluid line extends outward through the flap.

Clause 2. The bladder system according to Clause 1, further comprising a pump for supplying fluid from the fluid reservoir portion to the first fluid line.

Clause 3. The bladder system according to Clause 1, wherein the fluid reservoir portion includes a pump for supplying fluid to the first fluid line.

Clause 4. The bladder system according to Clause 2 or 3, further comprising a valve component configured to prevent fluid from moving from the pump into a main reservoir portion of the fluid reservoir portion.

Clause 5. The bladder system according to any one of Clauses 1 to 4, further comprising a valve component configured to prevent fluid from moving from the foot support bladder portion into the fluid reservoir portion through the first fluid line.

Clause 6. The bladder system according to any one of Clauses 1 to 5, wherein the foot support bladder portion, when inflated, defines a first interior volume V1, wherein the fluid reservoir portion, when inflated, defines a second interior volume V2, and wherein $0.8 \times V2 \leq V1 \leq 1.2 \times V2$.

Clause 7. The bladder system according to any one of Clauses 1 to 5, wherein the foot support bladder portion, when inflated, defines a first interior volume V1, wherein the fluid reservoir portion, when inflated, defines a second interior volume V2, and wherein $0.9 \times V2 \leq V1 \leq 1.1 \times V2$.

Clause 8. The bladder system according to any one of Clauses 1 to 7, wherein a second portion of the second fluid line and the first fluid line are located adjacent one another and are separated from one another by a seam.

Clause 9. The bladder system according to Clause 8, wherein the second portion of the second fluid line extends from a medial heel region of the fluid reservoir portion to the flap.

Clause 10. The bladder system according to Clause 8 or 9, wherein the first fluid line and the second portion of the second fluid line comprise a bend region to support rotation of the foot support bladder portion with respect to the fluid reservoir portion.

Clause 11. The bladder system according to any one of Clauses 1 to 10, wherein the first fluid line extends between a medial heel region of the fluid reservoir portion and a medial heel region of the foot support bladder portion.

Clause 12. The bladder system according to any one of Clauses 1 to 11, wherein the first portion of the second fluid line that extends through the flap includes an open U-shaped interior fluid channel.

Clause 13. The bladder system according to any one of Clauses 1 to 11, wherein the first portion of the second fluid line that extends through the flap includes an open interior fluid channel within the flap, the open interior fluid channel having a first arm, a second arm, and a base connecting the first arm and the second arm.

Clause 14. The bladder system according to Clause 13, wherein the first arm defines a first thinned region of the open interior fluid channel and the second arm defines a second thinned region of the open interior fluid channel.

Clause 15. The bladder system according to Clause 14, wherein the first thinned region is located adjacent the second thinned region.

Clause 16. The bladder system according to any one of Clauses 1 to 15, wherein the fluid reservoir portion includes a heel region, a forefoot region, and a midfoot region located between the heel region and the forefoot region.

Clause 17. The bladder system according to any one of Clauses 1 to 11, wherein the flap includes a pre-crease region at which the first portion of the second fluid line will pinch to or toward a closed configuration under an applied force.

Clause 18. The bladder system according to any one of Clauses 1 to 17, wherein the fluid reservoir portion includes an interior tensile member that controls an exterior shape of the fluid reservoir portion when inflated.

Clause 19. The bladder system according to any one of Clauses 1 to 18, wherein the foot support bladder portion includes an interior tensile member that controls an exterior shape of the foot support bladder portion when inflated.

Clause 20. The bladder system according to any one of Clauses 1 to 19, wherein the foot support bladder portion, the fluid reservoir portion, the first fluid line, and the second fluid line are thermoformed as a single part.

Clause 21. The bladder system according to any one of Clauses 1 to 20, wherein the bladder system forms a closed fluid system.

Clause 22. A bladder system, comprising:

a first thermoplastic elastomer layer joined to a second thermoplastic elastomer layer at one or more seams to form an interior fluid chamber comprising:

a foot support bladder portion, wherein a heel portion or a midfoot portion of the foot support bladder portion forms an outwardly extending flap;

a fluid reservoir portion;

a first fluid line extending between the fluid reservoir portion and the foot support bladder portion; and a second fluid line extending between the foot support bladder portion and the fluid reservoir portion, wherein a first portion of the second fluid line extends through the flap.

Clause 23. The bladder system according to Clause 22, wherein the one or more seams forming the interior fluid chamber further define a pump region having a pump chamber connected with the first fluid line.

Clause 24. The bladder system according to Clause 23, wherein the pump region is partially surrounded by the fluid reservoir portion.

Clause 25. The bladder system according to Clause 23 or 24, wherein the pump region is located at a heel support region of the bladder system.

Clause 26. The bladder system according to any one of Clauses 22 to 25, wherein the foot support bladder portion, when inflated, defines a first interior volume V1, wherein the fluid reservoir portion, when inflated, defines a second interior volume V2, and wherein $0.8 \times V2 \leq V1 \leq 1.2 \times V2$.

Clause 27. The bladder system according to any one of Clauses 22 to 25, wherein the foot support bladder portion, when inflated, defines a first interior volume V1, wherein the fluid reservoir portion, when inflated, defines a second interior volume V2, and wherein $0.9 \times V2 \leq V1 \leq 1.1 \times V2$.

Clause 28. The bladder system according to any one of Clauses 22 to 27, wherein a second portion of the second fluid line and the first fluid line are located adjacent one another and are separated from one another by a portion of the one or more seams.

Clause 29. The bladder system according to Clause 28, wherein the second portion of the second fluid line extends from a medial heel region of the fluid reservoir portion to the flap.

Clause 30. The bladder system according to any one of Clauses 22 to 29, wherein the first fluid line extends between a medial heel region of the fluid reservoir portion and a medial heel region of the foot support bladder portion.

Clause 31. The bladder system according to any one of Clauses 22 to 30, wherein the first portion of the second fluid line that extends through the flap includes an open U-shaped interior fluid channel.

Clause 32. The bladder system according to any one of Clauses 22 to 30, wherein the first portion of the second fluid line that extends through the flap includes an open interior fluid channel within the flap, the open interior fluid channel having a first arm, a second arm, and a base connecting the first arm and the second arm.

Clause 33. The bladder system according to Clause 32, wherein the first arm defines a first thinned region of the open interior fluid channel and the second arm defines a second thinned region of the open interior fluid channel.

Clause 34. The bladder system according to Clause 33, wherein the first thinned region is located adjacent the second thinned region, e.g., and is separated from the second thinned region by one of the one or more seams joining the first thermoplastic elastomer layer to the second thermoplastic elastomer layer.

Clause 35. The bladder system according to any one of Clauses 22 to 34, wherein the fluid reservoir portion includes a heel region, a forefoot region, and a midfoot region located between the heel region and the forefoot region.

Clause 36. The bladder system according to any one of Clauses 22 to 30, wherein the flap includes a pre-crease region at which the first portion of the second fluid line will pinch to or toward a closed configuration under an applied force.

Clause 37. The bladder system according to any one of Clauses 22 to 36, wherein the fluid reservoir portion includes an interior tensile member that controls an exterior shape of the fluid reservoir portion when inflated.

Clause 38. The bladder system according to any one of Clauses 22 to 37, wherein the foot support bladder portion includes an interior tensile member that controls an exterior shape of the foot support bladder portion when inflated.

Clause 39. The bladder system according to any one of Clauses 22 to 38, further comprising a single inflation port opening into the interior fluid chamber and configured to inflate each of the foot support bladder portion, the fluid reservoir portion, the first fluid line, and the second fluid line.

Clause 40. The bladder system according to any one of Clauses 22 to 39, wherein the one or more seams form the bladder system as a closed fluid system.

Clause 41. The bladder system according to any one of Clauses 22 to 40, wherein the first thermoplastic elastomer layer and the second thermoplastic elastomer layer are parts of a single sheet of thermoplastic elastomer material.

Clause 42. The bladder system according to any one of Clauses 22 to 40, wherein the first thermoplastic elastomer layer and the second thermoplastic elastomer layer are part of separate sheet components.

Clause 43. A bladder system, comprising:

a first thermoplastic elastomer layer and a second thermoplastic elastomer layer joined together by a first seam portion and a second seam portion, wherein a first interior bladder chamber is defined between the first thermoplastic elastomer layer and the second thermoplastic elastomer layer; and a first fluid line formed between the first thermoplastic elastomer layer and the second thermoplastic elastomer layer, the first fluid line having a first end that opens into the first interior bladder chamber, the first fluid line extending between the first seam portion and the second seam portion, wherein the first fluid line includes: (i) a first fluid line region having a first transverse cross sectional area and extending in a direction away from the first interior bladder chamber, (ii) a second fluid line region extending from the first fluid line region and in the direction away from the first interior bladder chamber, the second fluid line region having a second transverse cross sectional area that is smaller than the first transverse cross sectional area, and (iii) a third fluid line region extending from the second fluid line region and having a third transverse cross sectional area that is greater than the second transverse cross sectional area.

Clause 44. The bladder system according to Clause 43, wherein the first fluid line further includes: (i) a fourth fluid line region extending from the third fluid line region and in a direction toward the first interior bladder chamber, the fourth fluid line region having a fourth transverse cross sectional area, (ii) a fifth fluid line region extending from the fourth fluid line region and in the direction toward the first interior bladder chamber, the fifth fluid line region having a fifth transverse cross sectional area that is smaller than the fourth transverse cross sectional area, and (iii) a sixth fluid line region extending from the fifth fluid line region, the sixth fluid line region having a sixth transverse cross sectional area that is greater than the fifth transverse cross sectional area.

Clause 45. The bladder system according to Clause 44, wherein the second fluid line region is located adjacent the fifth fluid line region.

Clause 46. The bladder system according to Clause 44, wherein a third seam portion joining the first thermoplastic elastomer layer and the second thermoplastic elastomer layer: (i) defines adjacent sides of each of the first fluid line region and the sixth fluid line region and separates at least a portion of the first fluid line region from at least a portion of the sixth fluid line region and (ii) defines adjacent sides of each of the second fluid line region and the fifth fluid line region and separates at least a portion of the second fluid line region from at least a portion of the fifth fluid line region.

Clause 47. The bladder system according to Clause 44, wherein a third seam portion joining the first thermoplastic elastomer layer and the second thermoplastic elastomer layer: (i) defines adjacent sides of each of the first fluid line region and the sixth fluid line region and separates at least a portion of the first fluid line region from at least a portion of the sixth fluid line region, (ii) defines adjacent sides of each of the second fluid line region and the fifth fluid line region and separates at least a portion of the second fluid line region from at least a portion of the fifth fluid line region, and (iii) defines adjacent sides of each of the third fluid line region and the fourth fluid line region and separates at least a portion of the third fluid line region from at least a portion of the fourth fluid line region.

Clause 48. The bladder system according to any one of Clauses 44 to 47, wherein the sixth fluid line region extends along a portion of the second seam portion.

Clause 49. The bladder system according to any one of Clauses 44 to 48, further comprising a second interior bladder chamber, wherein the sixth fluid line region is in fluid communication with the second interior bladder chamber.

Clause 50. The bladder system according to any one of Clauses 44 to 48, wherein a second interior bladder chamber is defined between the first thermoplastic elastomer layer and the second thermoplastic elastomer layer, and wherein fluid leaving the sixth fluid line region opens into the second interior bladder chamber.

Clause 51. The bladder system according to Clause 49 or 50, further comprising: (i) a pump having an inlet receiving fluid from the second interior bladder chamber and an outlet; and (ii) a second fluid line extending from the outlet of the pump to the first interior bladder chamber.

Clause 52. The bladder system according to Clause 49 or 50, wherein the first thermoplastic elastomer layer and the second thermoplastic elastomer layer further define: (a) a pump region having an inlet receiving fluid from the second interior bladder chamber and an outlet and (b) a second fluid line extending from the outlet of the pump region to the first interior bladder chamber.

Clause 53. The bladder system according to Clause 51 or 52, wherein at least a portion of the second fluid line extends adjacent at least a portion of the sixth fluid line region.

Clause 54. The bladder system according to Clause 51 or 52, wherein at least a portion of the second fluid line and at least a portion of the sixth fluid line region are defined by and are separated from one another by a seam segment at which the first thermoplastic elastomer layer is joined with the second thermoplastic elastomer layer.

Clause 55. The bladder system according to any one of Clauses 44 to 54, wherein a linear fluid line length from a beginning of the first fluid line region through an end of the fifth fluid line region is less than 75 mm long.

Clause 56. The bladder system according to any one of Clauses 44 to 55, wherein each of the first transverse cross sectional area, the second transverse cross sectional area, the third transverse cross sectional area, the fourth transverse cross sectional area, and the fifth transverse cross sectional area is less than 500 $mm^2$.

Clause 57. The bladder system according to any one of Clauses 44 to 56, wherein at least a portion of the first fluid line region, the second fluid line region, the third fluid line region, the fourth fluid line region, the fifth fluid line region, and at least a portion of the sixth fluid line region form a U-shaped tab that extends outward from the first interior bladder chamber.

Clause 58. The bladder system according to any one of Clauses 44 to 57, wherein the second fluid line region and the fifth fluid line region form a pre-crease region for closing the first fluid line.

Clause 59. The bladder system according to any one of Clauses 43 to 58, wherein the first fluid line region extends away from the first interior bladder chamber at a rear heel support region of the bladder system.

Clause 60. A bladder system, comprising:

a first thermoplastic elastomer layer and a second thermoplastic elastomer layer joined together to define a first interior bladder chamber; and a first fluid line having a first end in fluid communication with the first interior bladder chamber, wherein the first fluid line includes: (i) a first fluid line region having a first transverse cross sectional area and extending in a direction away from the first interior bladder chamber, (ii) a second fluid line region extending from the first fluid line region and in the direction away from the first interior bladder chamber, the second fluid line region having a second transverse cross sectional area that is smaller than the first transverse cross sectional area, and (iii) a third fluid line region extending from the second fluid line region and in the direction away from the first interior bladder chamber, the third fluid line region having a third transverse cross sectional area that is greater than the second transverse cross sectional area.

Clause 61. The bladder system according to Clause 60, wherein the first fluid line further includes: (i) a fourth fluid line region extending from the third fluid line region and in a direction toward the first interior bladder chamber, the fourth fluid line region having a fourth transverse cross sectional area, (ii) a fifth fluid line region extending from the fourth fluid line region and in the direction toward the first interior bladder chamber, the fifth fluid line region having a fifth transverse cross sectional area that is smaller than the fourth transverse cross sectional area, and (iii) a sixth fluid line region extending from the fifth fluid line region, the sixth fluid line region having a sixth transverse cross sectional area that is greater than the fifth transverse cross sectional area.

Clause 62. The bladder system according to Clause 61, wherein the second fluid line region is located adjacent the fifth fluid line region.

Clause 63. The bladder system according to Clause 61, wherein a first seam portion: (i) defines adjacent sides of each of the first fluid line region and the sixth fluid line region and separates at least a portion of the first fluid line region from at least a portion of the sixth fluid line region and (ii) defines adjacent sides of each of the second fluid line region and the fifth fluid line region and separates at least a portion of the second fluid line region from at least a portion of the fifth fluid line region.

Clause 64. The bladder system according to Clause 61, wherein a first seam portion: (i) defines adjacent sides of each of the first fluid line region and the sixth fluid line region and separates at least a portion of the first fluid line region from at least a portion of the sixth fluid line region, (ii) defines adjacent sides of each of the second fluid line region and the fifth fluid line region and separates at least a portion of the second fluid line region from at least a portion of the fifth fluid line region, and (iii) defines adjacent sides of each of the third fluid line region and the fourth fluid line region and separates at least a portion of the third fluid line region from at least a portion of the fourth fluid line region.

Clause 65. The bladder system according to any one of Clauses 61 to 64, further comprising a second interior bladder chamber, wherein the sixth fluid line region is in fluid communication with the second interior bladder chamber.

Clause 66. The bladder system according to Clause 65, further comprising: (i) a pump having an inlet receiving fluid from the second interior bladder chamber and an outlet; and (ii) a second fluid line extending from the outlet of the pump to the first interior bladder chamber.

Clause 67. The bladder system according to Clause 66, wherein at least a portion of the second fluid line extends adjacent at least a portion of the sixth fluid line region.

Clause 68. The bladder system according to Clause 66, wherein at least a portion of the second fluid line and at least a portion of the sixth fluid line region are defined by and are separated from one another by a seam segment.

Clause 69. The bladder system according to any one of Clauses 61 to 68, wherein a linear fluid line length from a beginning of the first fluid line region through an end of the fifth fluid line region is less than 75 mm long.

Clause 70. The bladder system according to any one of Clauses 61 to 70, wherein each of the first transverse cross sectional area, the second transverse cross sectional area, the third transverse cross sectional area, the fourth transverse cross sectional area, and the fifth transverse cross sectional area is less than 500 $mm^2$.

Clause 71. The bladder system according to any one of Clauses 61 to 70, wherein at least a portion of the first fluid line region, the second fluid line region, the third fluid line region, the fourth fluid line region, the fifth fluid line region, and at least a portion of the sixth fluid line region form a U-shaped tab that extends outward from the first interior bladder chamber.

Clause 72. The bladder system according to any one of Clauses 61 to 71, wherein the second fluid line region and the fifth fluid line region form a pre-crease region for closing the first fluid line.

Clause 73. The bladder system according to any one of Clauses 60 to 72, wherein the first fluid line region extends away from the first interior bladder chamber at a rear heel support region of the bladder system.

Clause 74. A sole structure, comprising: (A) a sole component; and (B) a bladder system according to any one of Clauses 1-73 fixed to the sole component.

Clause 75. An article of footwear, comprising: (A) a footwear upper; and (B) a sole structure according to Clause 74 fixed to the upper.

What is claimed is:

1. A bladder system for containing a fluid, the bladder system comprising:

a foot support bladder portion, wherein a heel portion or a midfoot portion of the foot support bladder portion forms an outwardly extending flap;

a fluid reservoir portion;

a first fluid line for moving fluid from the fluid reservoir portion to the foot support bladder portion; and a second fluid line for moving fluid from the foot support bladder portion to the fluid reservoir portion, wherein a first portion of the second fluid line extends through the flap, wherein a second portion of the second fluid line extends away from the flap, along a medial heel edge of the foot support bladder portion, and to a medial heel region of the fluid reservoir portion, and wherein the second portion of the second fluid line and the first fluid line: (a) extend between the foot support bladder portion and the fluid reservoir portion, (b) are located adjacent one another, and (c) are separated from one another by a seam.

2. The bladder system according to claim 1, wherein an area of the flap through which the first portion of the second fluid line extends is less than 1200 $mm^2$, and wherein a linear fluid line length of the first portion of the second fluid line within the flap is less than 75 mm long.

3. The bladder system according to claim 1, wherein an area of the flap through which the first portion of the second fluid line extends is less than 2000 $mm^2$, and wherein a linear fluid line length of the first portion of the second fluid line within the flap is less than 100 mm long.

4. The bladder system according to claim 1, wherein the first fluid line extends between the medial heel region of the fluid reservoir portion and a medial heel region of the foot support bladder portion.

5. The bladder system according to claim 1, wherein the first portion of the second fluid line that extends through the flap includes an open U-shaped interior fluid channel.

6. The bladder system according to claim 1, wherein the first portion of the second fluid line that extends through the flap includes an open interior fluid channel within the flap, the open interior fluid channel having a first arm, a second arm, and a base connecting the first arm and the second arm.

7. The bladder system according to claim 6, wherein the first arm defines a first thinned region of the open interior fluid channel and the second arm defines a second thinned region of the open interior fluid channel, wherein the first thinned region is located adjacent the second thinned region.

8. The bladder system according to claim 1, wherein the foot support bladder portion, the fluid reservoir portion, the first fluid line, and the second fluid line are thermoformed as a single part.

9. A bladder system, comprising:

a first thermoplastic elastomer layer joined to a second thermoplastic elastomer layer at one or more seams to form an interior fluid chamber comprising:

a foot support bladder portion, wherein a heel portion or a midfoot portion of the foot support bladder portion forms an outwardly extending flap;

a fluid reservoir portion;

a first fluid line extending between the fluid reservoir portion and the foot support bladder portion; and a second fluid line extending between the foot support bladder portion and the fluid reservoir portion, wherein a first portion of the second fluid line extends through the flap, wherein a second portion of the second fluid line extends away from the flap, along a medial heel edge of the foot support bladder portion, and to a medial heel region of the fluid reservoir portion, and wherein the second portion of the second fluid line and the first fluid line: (a) extend between the foot support bladder portion and the fluid reservoir portion, (b) are located adjacent one another, and (c) are separated from one another by a portion of the one or more seams.

10. The bladder system according to claim 9, wherein the one or more seams forming the interior fluid chamber further define a pump region having a pump chamber connected with the first fluid line, wherein the pump region is partially surrounded by the fluid reservoir portion.

11. The bladder system according to claim 10, wherein the pump region is located at a heel support region of the bladder system.

12. The bladder system according to claim 9, wherein an area of the flap through which the first portion of the second fluid line extends is less than 1200 $mm^2$, and wherein a linear fluid line length of the first portion of the second fluid line within the flap is less than 75 mm long.

13. The bladder system according to claim 9, wherein an area of the flap through which the first portion of the second fluid line extends is less than 2000 $mm^2$, and wherein a linear fluid line length of the first portion of the second fluid line within the flap is less than 100 mm long.

14. The bladder system according to claim 9, wherein the first fluid line extends between the medial heel region of the fluid reservoir portion and a medial heel region of the foot support bladder portion.

15. The bladder system according to claim 9, wherein the first portion of the second fluid line that extends through the flap includes an open U-shaped interior fluid channel.

16. The bladder system according to claim 9, wherein the first portion of the second fluid line that extends through the flap includes an open interior fluid channel within the flap, the open interior fluid channel having a first arm, a second arm, and a base connecting the first arm and the second arm.

17. The bladder system according to claim 16, wherein the first arm defines a first thinned region of the open interior fluid channel and the second arm defines a second thinned region of the open interior fluid channel, and wherein the first thinned region is located adjacent the second thinned region and is separated from the second thinned region by one of the one or more seams joining the first thermoplastic elastomer layer to the second thermoplastic elastomer layer.

18. The bladder system according to claim 9, wherein the flap includes a pre-crease region at which the first portion of the second fluid line will pinch to or toward a closed configuration under an applied force.

19. The bladder system according to claim 9, further comprising a single inflation port opening into the interior fluid chamber and configured to inflate each of the foot support bladder portion, the fluid reservoir portion, the first fluid line, and the second fluid line.

20. A sole structure, comprising:

a sole component; and a bladder system according to claim 1 fixed to the sole component.

* * * * *